US006585554B1

(12) United States Patent
Hewitt et al.

(10) Patent No.: US 6,585,554 B1
(45) Date of Patent: Jul. 1, 2003

(54) MUSICAL DRAWING ASSEMBLY

(75) Inventors: William R. Hewitt, West Falls, NY (US); Daniel Dignitti, Hamburg, NY (US); Jeffrey J. Miller, Orchard Park, NY (US); Martin Wilson, Holland, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/499,537

(22) Filed: Feb. 11, 2000

(51) Int. Cl.[7] ..... A63H 13/15; B43L 1/00
(52) U.S. Cl. ..... 446/146; 446/397; 434/408
(58) Field of Search ..... 434/85; 446/408

(56) References Cited

U.S. PATENT DOCUMENTS

| | | | | |
|---|---|---|---|---|
| 3,690,020 | A | 9/1972 | McBratnie | |
| 3,795,989 | A | 3/1974 | Greenberg et al. | |
| 3,800,437 | A | 4/1974 | Lamberson | |
| 3,956,958 | A | 5/1976 | Nash et al. | |
| 4,740,161 | A | 4/1988 | Schwartz et al. | |
| 4,887,968 | A | 12/1989 | Wickstead et al. | |
| 5,266,737 | A | 11/1993 | Okamoto | 84/626 |
| 5,355,762 | A | 10/1994 | Tabata | |
| 5,413,355 | A | 5/1995 | Gonzalez | |
| 5,448,008 | A | 9/1995 | Okamoto et al. | |
| 5,488,204 | A | 1/1996 | Mead et al. | |
| 5,501,601 | A | 3/1996 | Todokoro et al. | 434/169 |
| 5,512,707 | A | 4/1996 | Ohshima | |
| 5,604,517 | A * | 2/1997 | Filo | 434/163 |
| 5,636,995 | A | 6/1997 | Sharpe, III et al. | 434/317 |
| 5,670,992 | A | 9/1997 | Yasuhara et al. | 345/173 |
| 5,684,259 | A | 11/1997 | Horii | |
| D387,383 | S | 12/1997 | Chan | |
| 5,816,885 | A | 10/1998 | Goldman et al. | 446/397 |
| 5,829,985 | A | 11/1998 | Campanella | |
| 5,851,119 | A | 12/1998 | Sharpe, III et al. | 434/317 |
| 5,867,914 | A | 2/1999 | Watson et al. | 33/18.1 |
| 6,005,545 | A | 12/1999 | Nishida et al. | |
| 6,201,947 | B1 | 3/2001 | Hur et al. | |

FOREIGN PATENT DOCUMENTS

| | | |
|---|---|---|
| DE | 1 945 784 | 3/1971 |
| EP | 0 414 566 A2 | 2/1991 |
| EP | 0 455 147 A1 | 11/1991 |
| EP | 1 013 323 A1 | 6/2000 |
| JP | HEI 4-19567 | 3/1992 |
| JP | 408335076 A | 12/1996 |
| WO | WO 88/04861 A1 | 6/1988 |
| WO | WO99/13955 | 3/1999 |

OTHER PUBLICATIONS

"Do Re Mi" or Pinocchio device by Agatsuma K.K. including photocopies of box and 8 photographs of the exterior and interior of device. Also photocopies of the front and back of the box along with English language translations are provided. Product publicly available in Japan at least as early as Dec. 1993.

Ad for VTech's "Little Smart Magic Letters", VTech Product Catalog (publication date unknown).

* cited by examiner

*Primary Examiner*—Derris H. Banks
*Assistant Examiner*—Faye Francis
(74) *Attorney, Agent, or Firm*—Cooley Godward LLP

(57) ABSTRACT

A musical drawing assembly having a drawing board on which a person can draw. A sensor is adapted to sense drawing movement on the drawing board. A storage device stores accompaniment melodies each having a different succession of musical tones. The storage device stores instrumental melodies corresponding to different musical instruments and each having a different succession of musical tones. The musical drawing assembly also includes a device for selecting one of the accompaniment melodies, and a device for selecting a musical instrument that corresponds to one of the different musical instruments. A controller is configured to output the selected one of the accompaniment melodies to an output device during the drawing movement and to output one of the instrumental melodies that corresponds to the selected instrument to the output device in response to the drawing movement.

31 Claims, 30 Drawing Sheets

MUSICAL DRAWING ASSEMBLY

BACKGROUND OF THE INVENTION

1. Field of the Invention

The present invention relates to toys and, more particularly, to an assembly that plays music in response to drawing movement.

2. Description of the Related Art

Conventional toys permit users, primarily children, to create music by drawing on a surface of a toy. However, these devices are deficient in that they limit a child's ability to create musical compositions of varying content. Hence, such devices do not encourage musical creativity. Nor do they keep the interest of children.

Other conventional devices function as musical instruments that permit a user to create complicated musical compositions of varying content. However, such devices do not create music in response to any creative action, such as drawing, and are too complicated for children to operate. Hence, these devices also fail to keep the interest of children and do not foster creativity.

It is thus apparent that a need exists for a simple device by which a child can create musical compositions of varying content in response to creative action by the child so as to keep the child's interest and encourage creativity.

SUMMARY OF THE INVENTION

Generally speaking, embodiments of the present invention provide a musical drawing assembly by which a child can create musical compositions of varying content in response to creative action by the child so as to keep the child's interest and encourage creativity.

According to a one aspect of an embodiment of the present invention, a musical drawing assembly includes a drawing board on which a person can draw. A sensor senses drawing movement on the drawing board. A storage device stores musical melodies, where the musical melodies each having a different succession of musical tones. A controller determines a type of drawing movement on the drawing board based on an output from the sensor, and selects one of the musical melodies from the storage device based on the determined type of drawing movement. The controller then outputs the selected one of the musical melodies to an output device.

According to a further aspect of an embodiment of the present invention, a musical drawing assembly includes a drawing board on which a person can draw. A storage device stores at least a first musical melody and a second musical melody. The first musical melody has a different succession of musical tones than the second musical melody. The musical drawing assembly also includes a device that detects a type of drawing movement on the drawing board and that generates music in response to the detected type of drawing movement. The generated music includes the first musical melody or the second musical melody, dependent upon the detected type of drawing movement.

According to another aspect of an embodiment of the present invention, a musical drawing assembly includes a drawing board on which a person can draw. A sensor is adapted to sense drawing movement on the drawing board. A storage device stores accompaniment melodies each having a different succession of musical tones. The storage device stores instrumental melodies corresponding to different musical instruments and each having a different succession of musical tones. The musical drawing assembly also includes a device for selecting one of the accompaniment melodies, and a device for selecting a musical instrument that corresponds to one of the different musical instruments. A controller is configured to output the selected one of the accompaniment melodies to an output device during the drawing movement and to output one of the instrumental melodies that corresponds to the selected instrument to the output device in response to the drawing movement.

According to yet a further aspect of an embodiment of the present invention, a method of generating music includes: sensing drawing movement on a drawing board; determining the type of drawing movement on the drawing board based on the sensed drawing movement; selecting a musical melody from stored musical melodies based on the determined type of drawing movement, where the musical melodies each having a different succession of musical tones; and outputting the selected one of the musical melodies to the output device.

According to another aspect of an embodiment of the present invention a method of generating music includes: receiving a selection of an accompaniment melody; receiving a selection of a musical instrument; sensing drawing movement on a drawing board; determining which of a plurality of stored instrument melodies corresponds to the selected musical instrument; outputting to an output device in response to drawing movement at least one of the instrument melodies determined to correspond to the selected musical instrument; and outputting the selected accompaniment melody to the output device.

Other objects, advantages and features associated with the present invention will become more readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DETAILED DESCRIPTION OF THE PREFERRED EMBODIMENTS

The presently preferred embodiment of a musical drawing assembly incorporating the principles of the present invention is illustrated and described in reference FIGS. 1 through 14.

Figure 1:
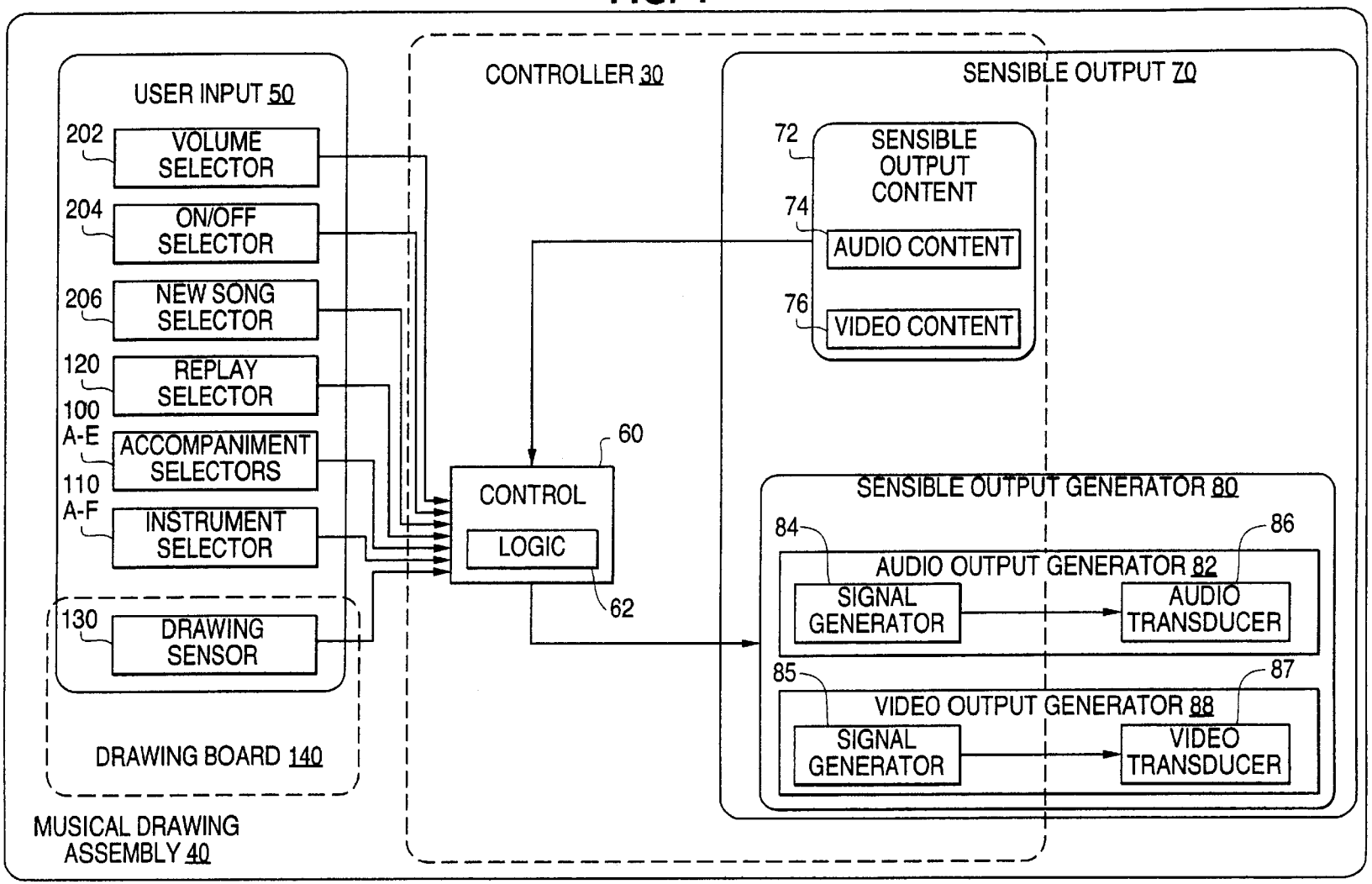
FIG. 1 is a functional block diagram of a musical drawing assembly embodying the principals of one embodiment of the present invention.

As shown in the functional block diagram of FIG. 1, musical drawing assembly 40 includes a user input block 50, a control block 60, and a sensible output block 70. In response to user input via the input block 50, the control block 60 controls the output of selected sensible output, such as mechanical vibration, musical notes, sound effects, light patterns, or a combination of musical notes and light patterns, from the output block 70.

Output block 70 includes sensible output content 72, which includes audio content 74 and video content 76. Audio content 74 can include, for example, in either digital or analog form, musical notes (which can be combined to form musical compositions), speech (recorded or synthesized), or sounds (including recorded natural sounds, or electronically synthesized sounds). In the preferred embodiment, audio content 74 includes a number of audio contents, such as those schematically illustrated in FIG. 10 and further described below. Video content 76 can include, for example, in analog or digital form, still or video images, or simply control signals for activation of lamps or other light-emitting devices.

Although not illustrated, the sensible output content 72 can also include vibratory content, such as control signals for activation of devices that produce mechanical vibrations that can be communicated to a surface in contact with a user so that the user can feel the vibration. In this case, the sensible output generator would include a vibratory output generator having a signal generator and a vibratory transducer.

Figure 2:
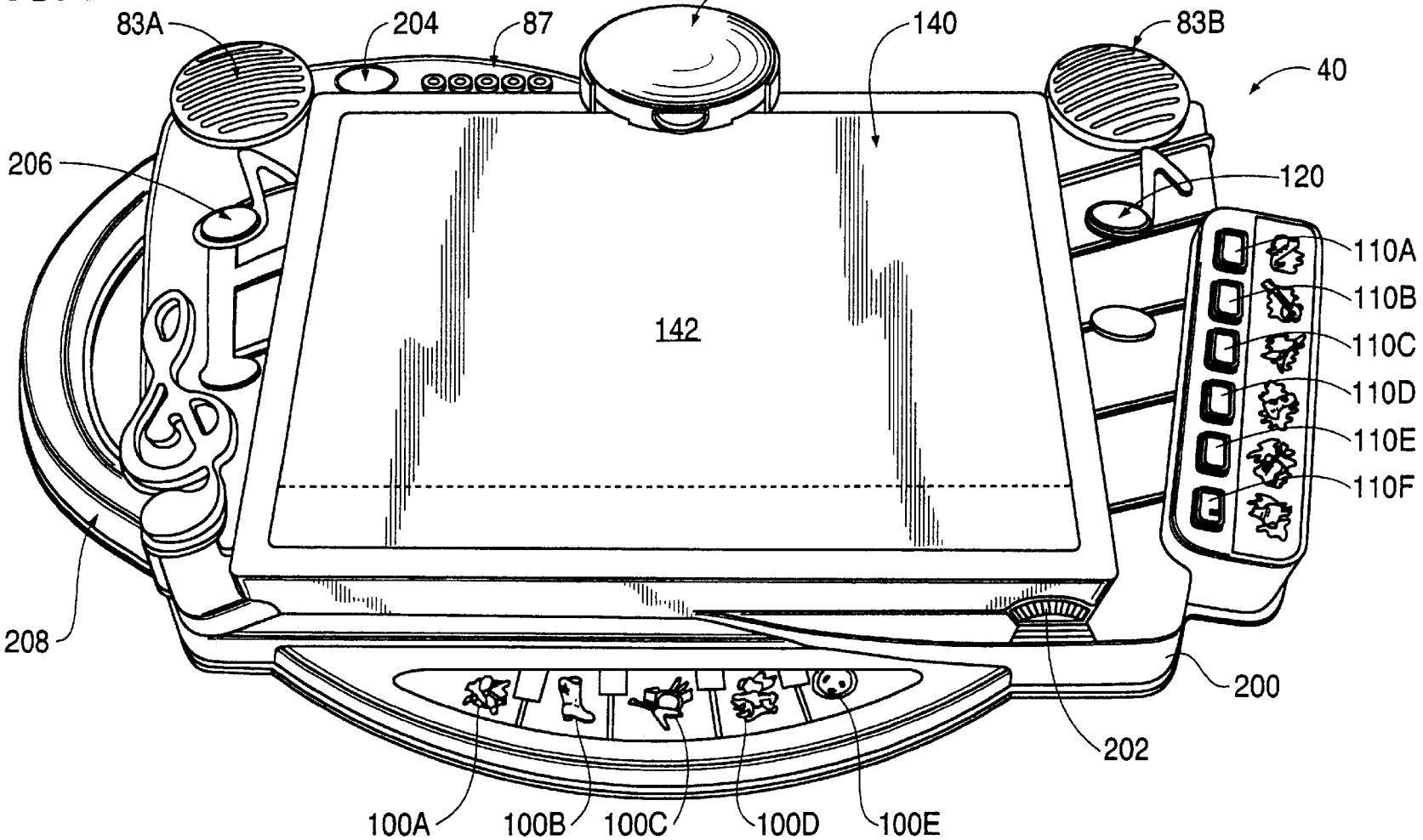
FIG. 2 is a front perspective view of a musical drawing assembly according to one embodiment of the present invention.
Figure 4:
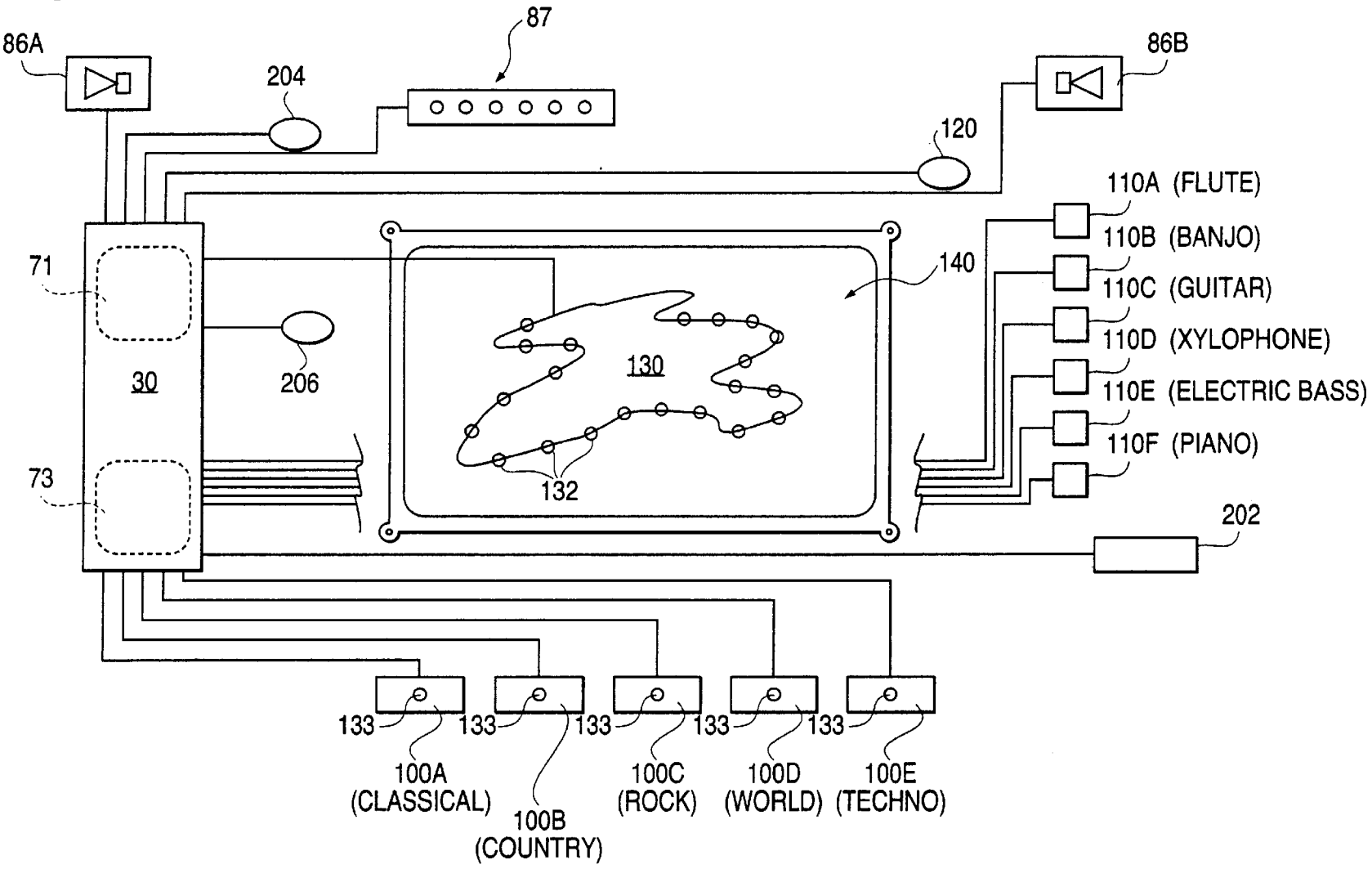
FIG. 4 is a schematic diagram of various components of the musical drawing assembly illustrated in FIGS. 2 and 3.

The output content can be sensibly communicated to a user for hearing or viewing by sensible output generator 80, which includes an audio output generator 82 and a video output generator 88. Audio output generator 82 includes an audio signal generator 84, which converts audio output content 74 into signals suitable for driving an audio transducer 86, such as a speaker, for converting the signals into suitable audible sound waves. As illustrated in FIGS. 2 and 4, in the preferred embodiment of the musical drawing assembly 40, the audio transducer includes two audio speakers 86A, 86B for playing music. Video output generator 88 includes video signal generator 85, which converts video output content 76 into a signal suitable for driving a video transducer 87, such as a display screen or lights, for converting the signals into visible light waves. In the preferred embodiment, the video transducer 87 includes an LED display, which is controlled by the controller such that the LED lights pulsate with the music outputted by the speakers 86A, 86B.

In an alternative embodiment, the video transducer 87 includes a video display screen that displays videos corresponding to the music played by the speakers 86A, 86B. Video output generator 84 can also include moving physical objects, such as miniature figures, to produce visual stimulus to the user. As described further below, the selection of the sensible output content 72, and the performance attributes of the output generator 80 are dictated by a user's input, such as a child playing with the musical drawing assembly 40.

Controller 30 is a device that serves to govern, in some predetermined manner, the selection of the sensible output content 72. Control block 60 of the controller 30 controls sensible output block 70, selecting the output content to be output and activating the output generator 80 to operate on the selected output content. The operation of control block 60 is governed by control logic 62, which can be, for example, computer software code. Control logic 62 selects content to be output repetitively or non-repetitively, randomly or in fixed sequences, and/or for short or long durations. The audio output from the speakers 86A, 86B and the audio output form the LED's are timed by the controller 30 such that the LED pulsates with the music outputted by the speakers. In the preferred embodiment, the controller 30 is a central processing unit, such as a printed circuit board having a programmed microprocessor and memory. It will also be appreciated that the many operations of the controller 30 can be completed by any combination of remotely located and different devices that collectively function as the controller 30.

As shown in FIG. 4, the sensible output content 72 is stored in a storage device 71 of the controller 30. The storage device can be a RAM, ROM, buffer, or other memory. In one embodiment, the sensible output content 72 is stored in a ROM of a central processing unit that functions as the controller 30. However, in an alternative embodiment, the storage device that stores the sensible output content 72 is located remote from the controller 30, such as in an external magnetic disk drive, PC card, optical disk, or other storage device.

User input block 50 includes a number of devices through which a user can input information to achieve a desired result. The user input block 50 includes accompaniment melody selectors 100A, 100B, 100C, 100D, 100E, instrument selectors 110A, 110B, 110C, 110D, 110E, 110F, a replay selector 120, a drawing sensor 130, a volume selector 202, an on/off selector 204, and a new song selector 206. Selectors 202, 204, 206, 110, 120 and drawing sensor 130 are illustrated in FIGS. 2 and 4 and are devices by which the user can provide input to control block 60 to influence the selection of output content and to initiate its output. Selectors 202, 204, 206, 110, 120 can be any variety of communication devices that permit a user of the musical drawing assembly 40 to input desired information to the control block 60. Examples of suitable selectors include electromechanical switches (keys, dials, buttons, pads, etc.), as well as interactive displays (pull-down menus, selectable icons, etc.).

Figure 10:
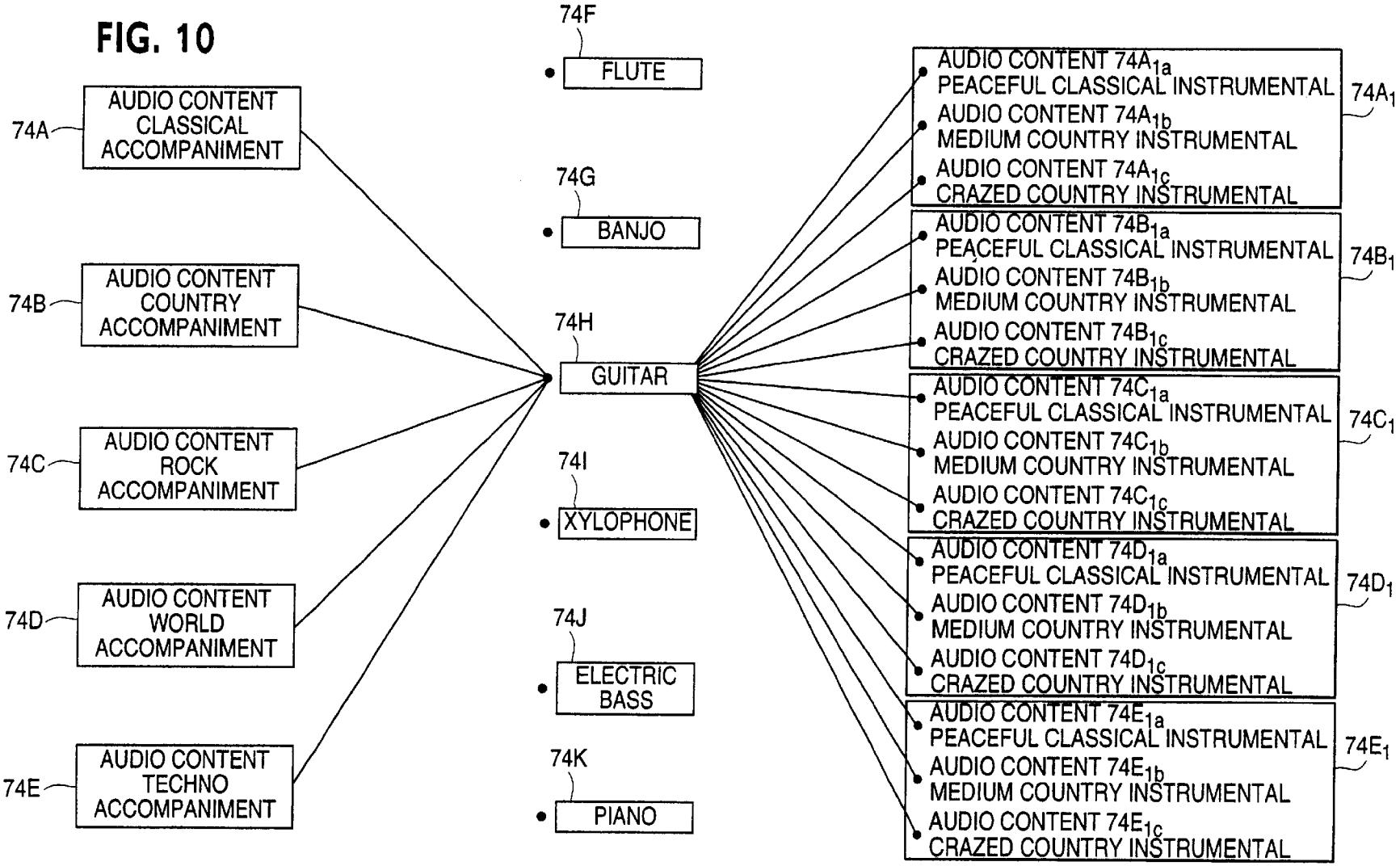
FIG. 10 is a schematic illustration of accompaniment and instrumental audio contents.
Figure 11A:
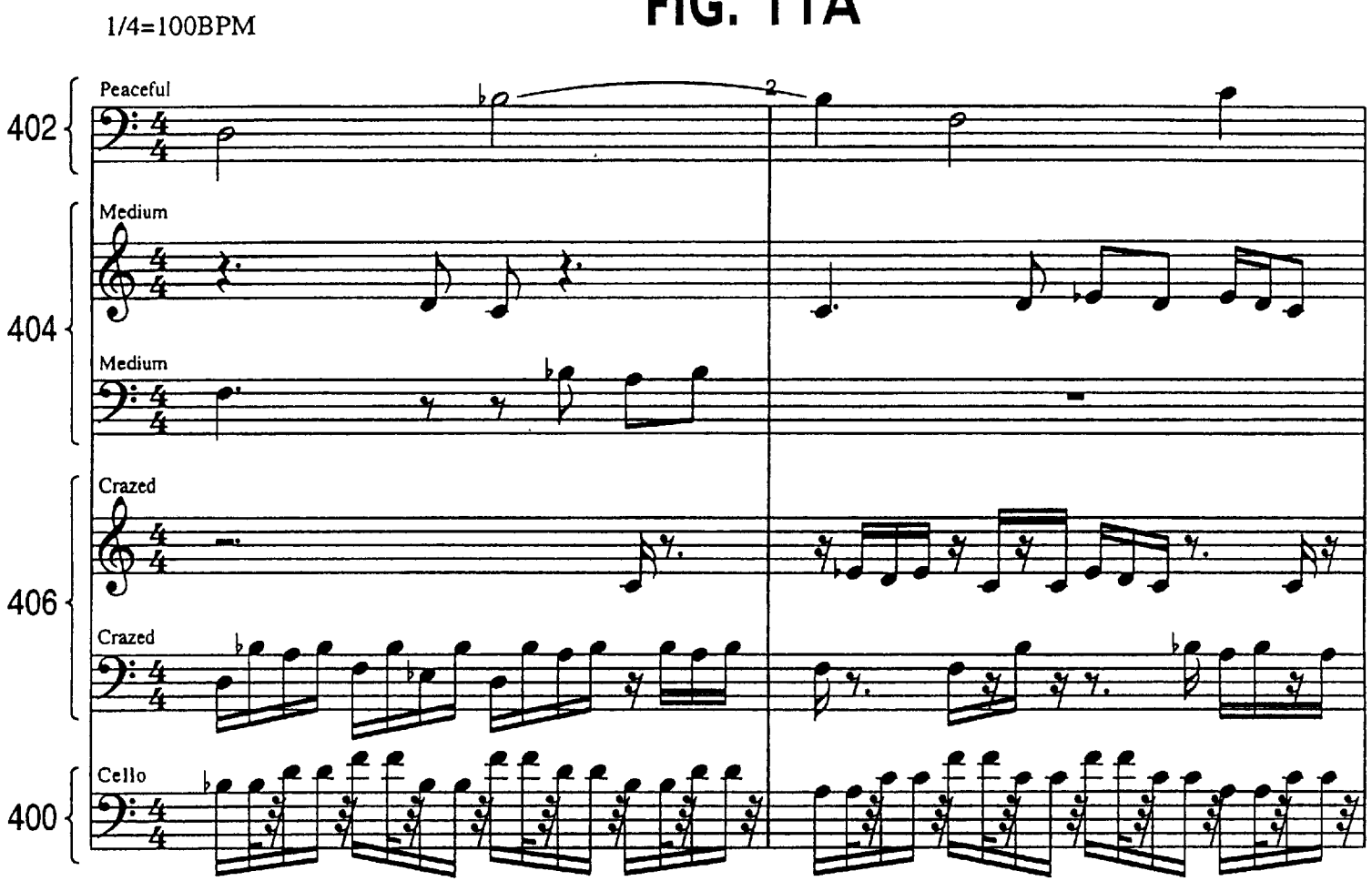
FIGS. 11A–11H illustrate one embodiment of a classical music score of an audio content.
Figure 11B:
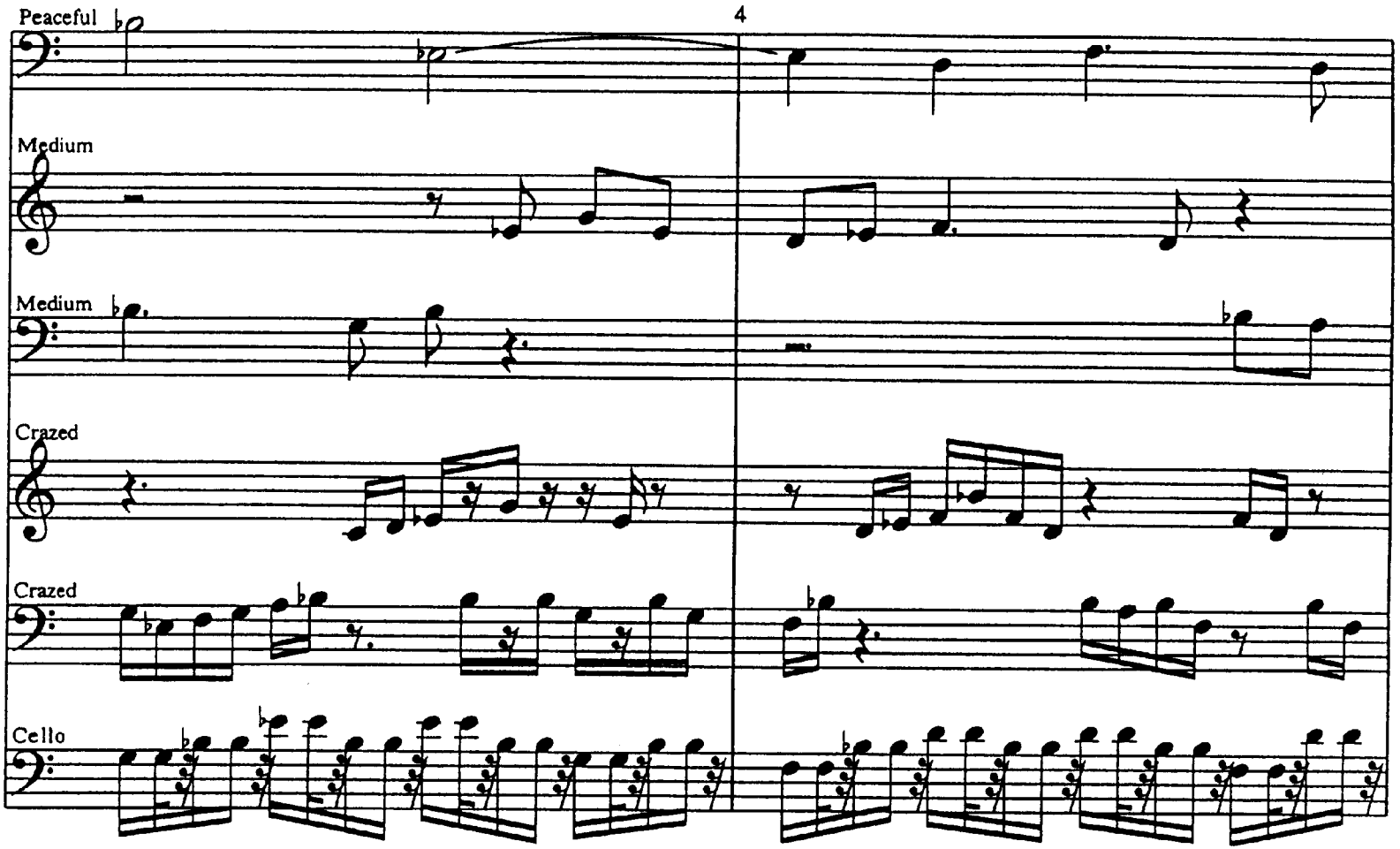
Figure 11C:
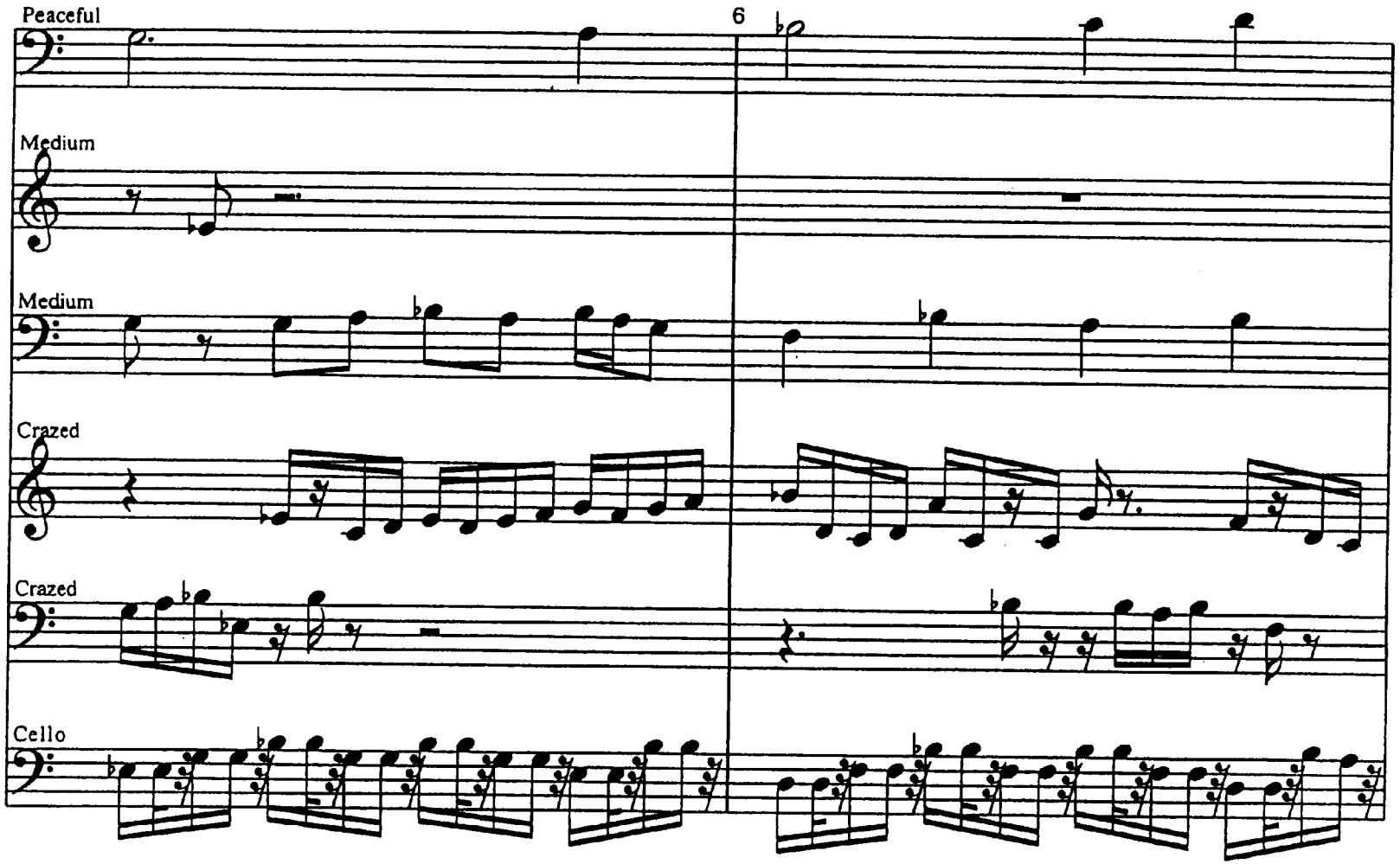
Figure 11D:
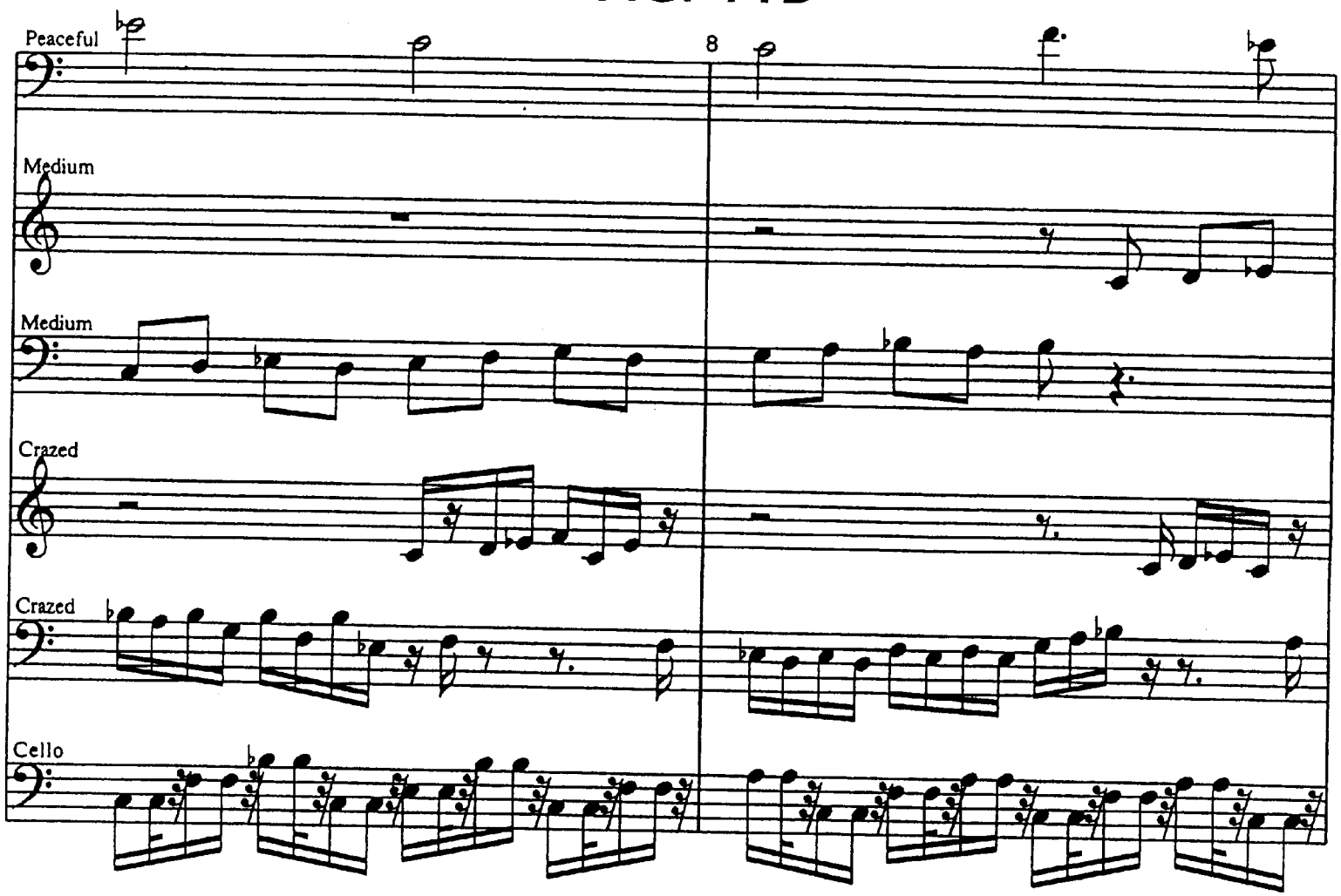
Figure 11E:
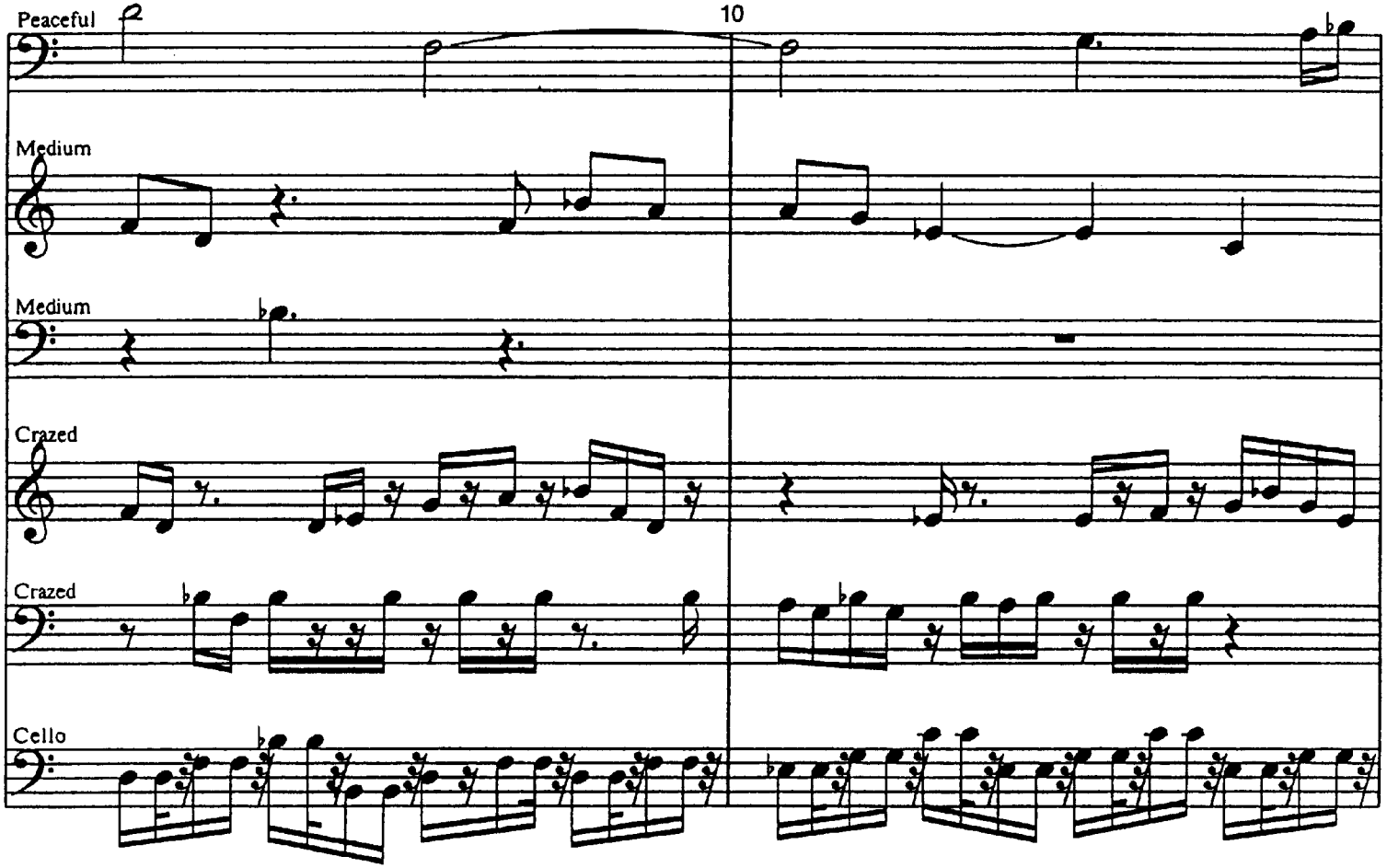
Figure 11F:
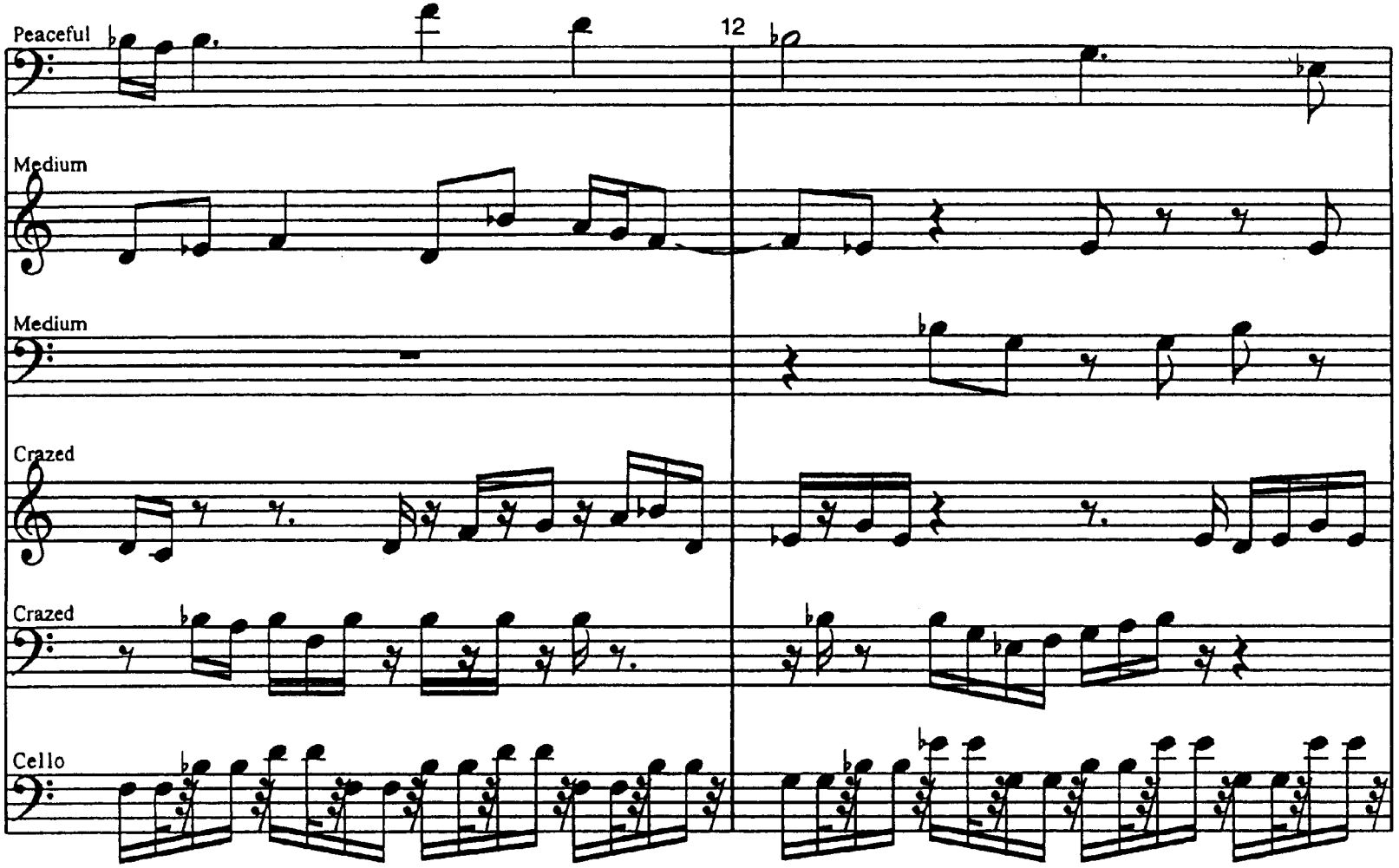
Figure 11G:
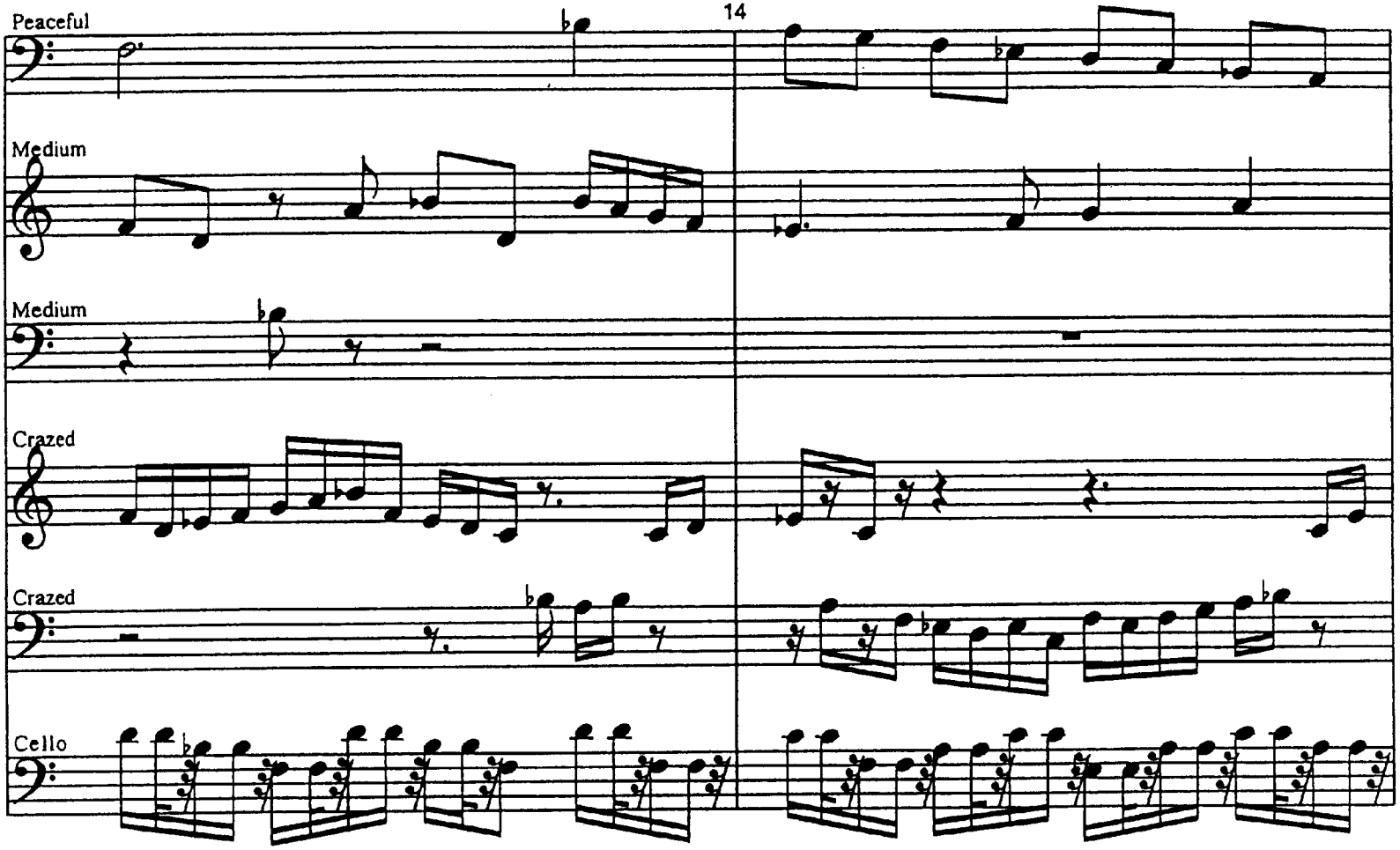
Figure 11H:
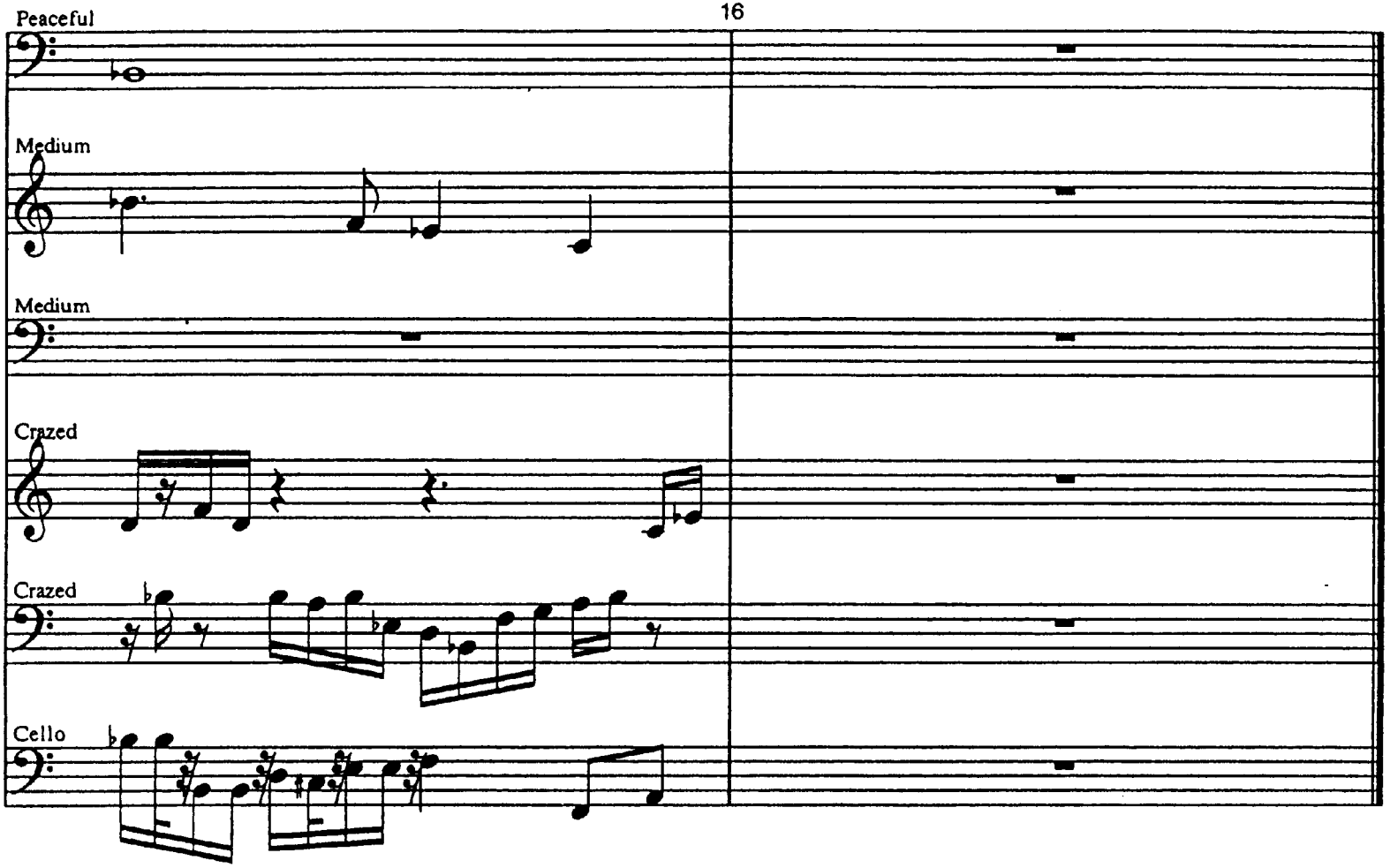
Figure 12A:
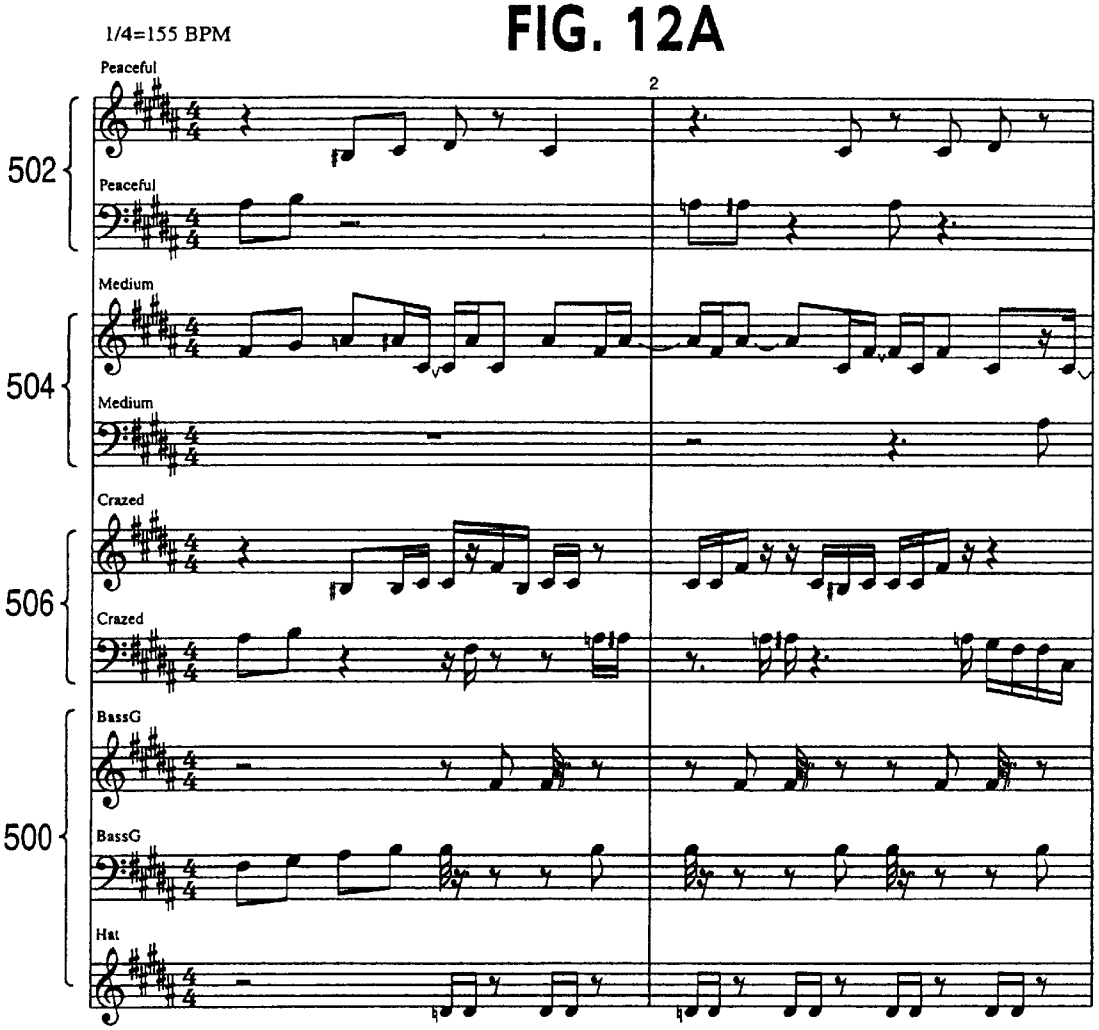
FIGS. 12A–12I illustrate one embodiment of a country music score of an audio content.
Figure 12B:
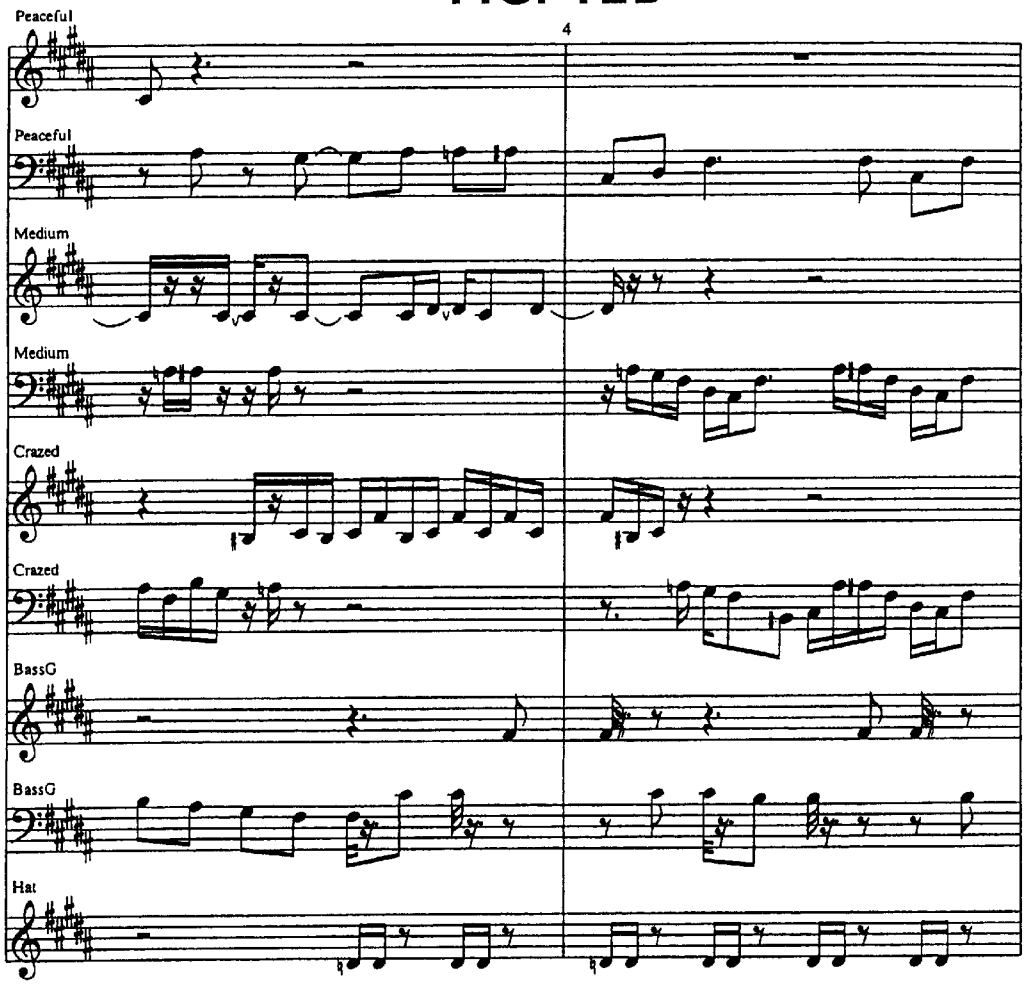
Figure 12C:
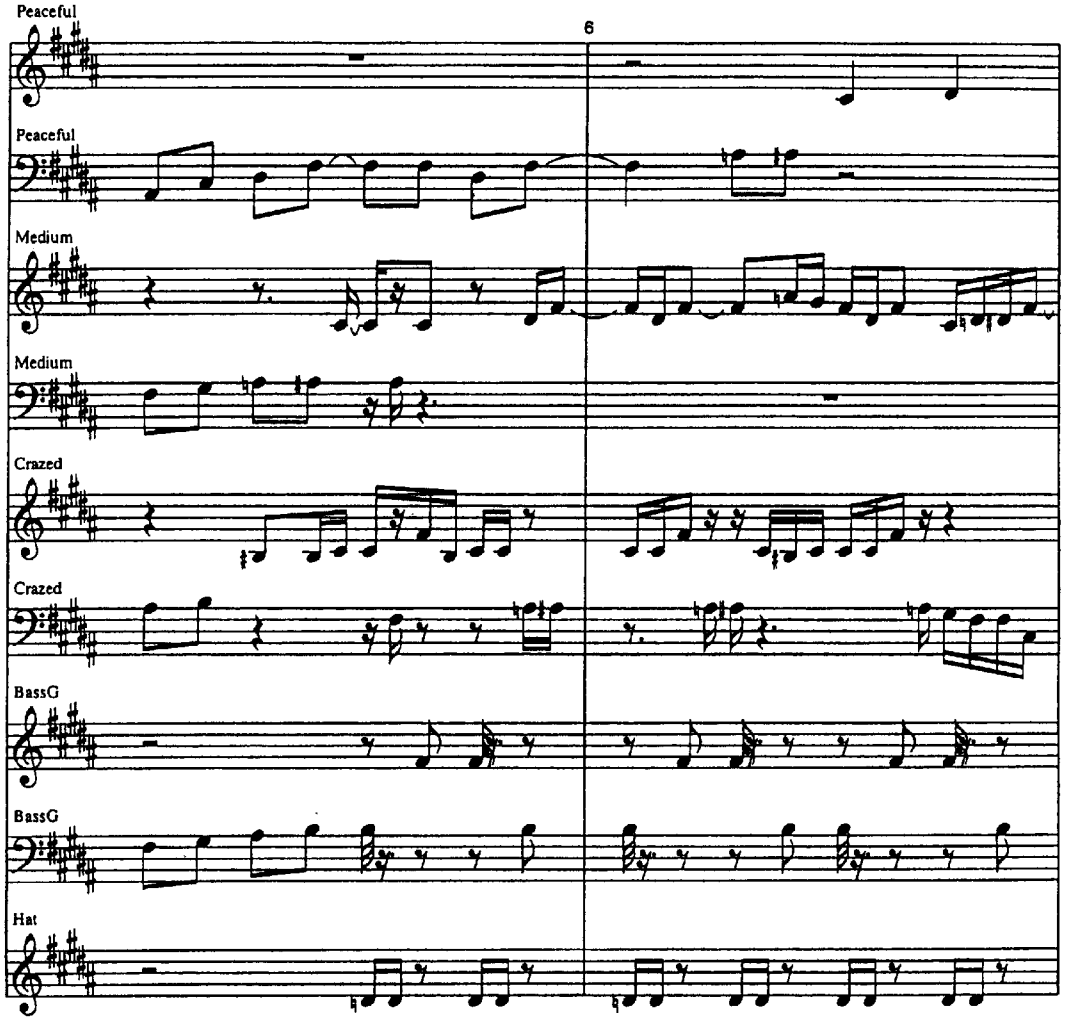
Figure 12D:
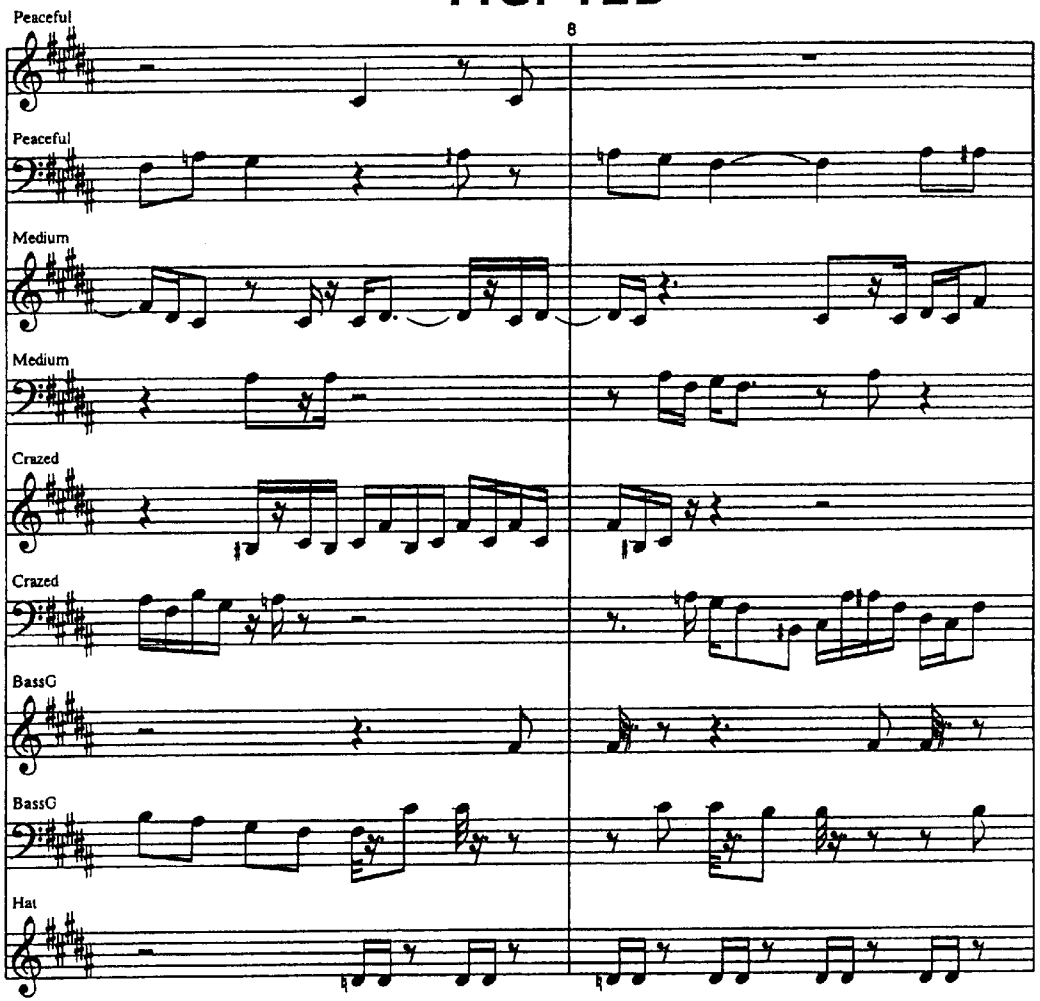
Figure 12E:
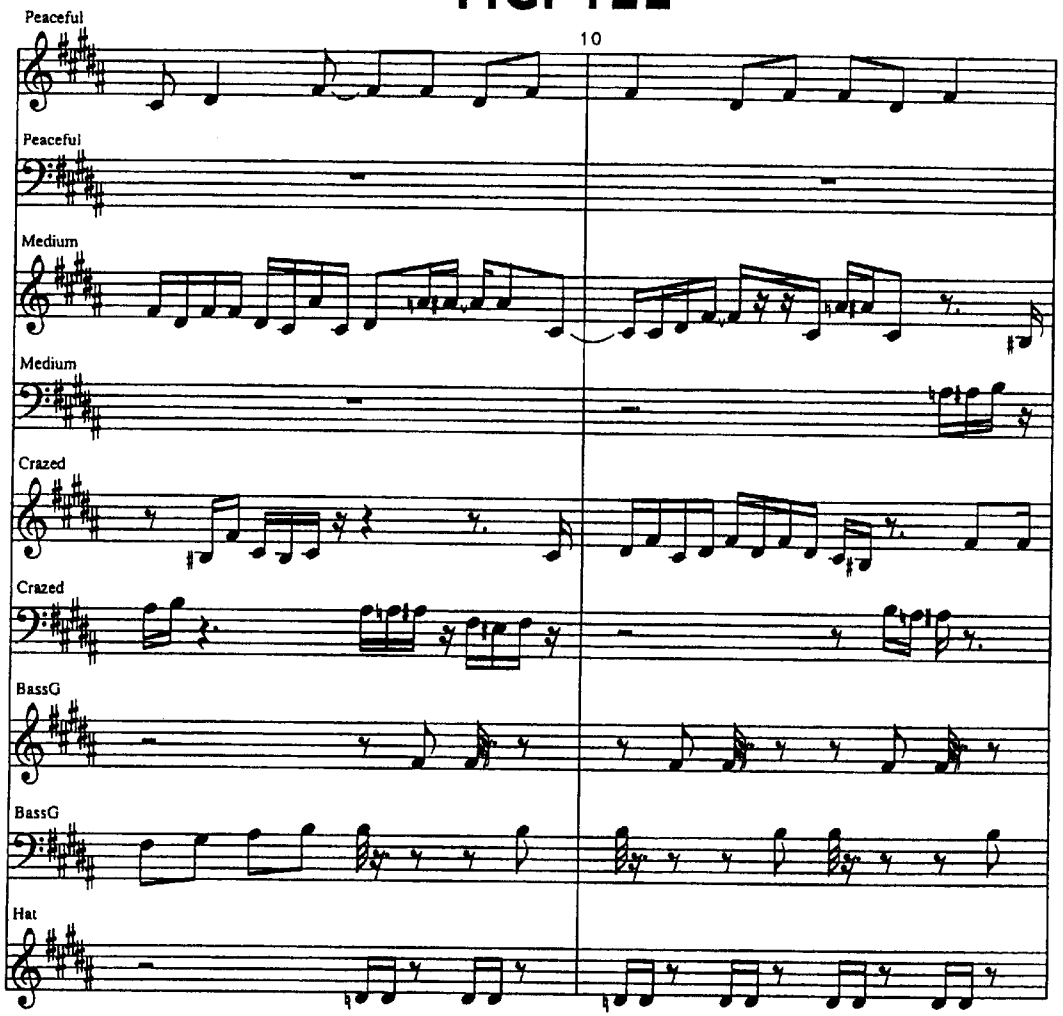
Figure 12F:
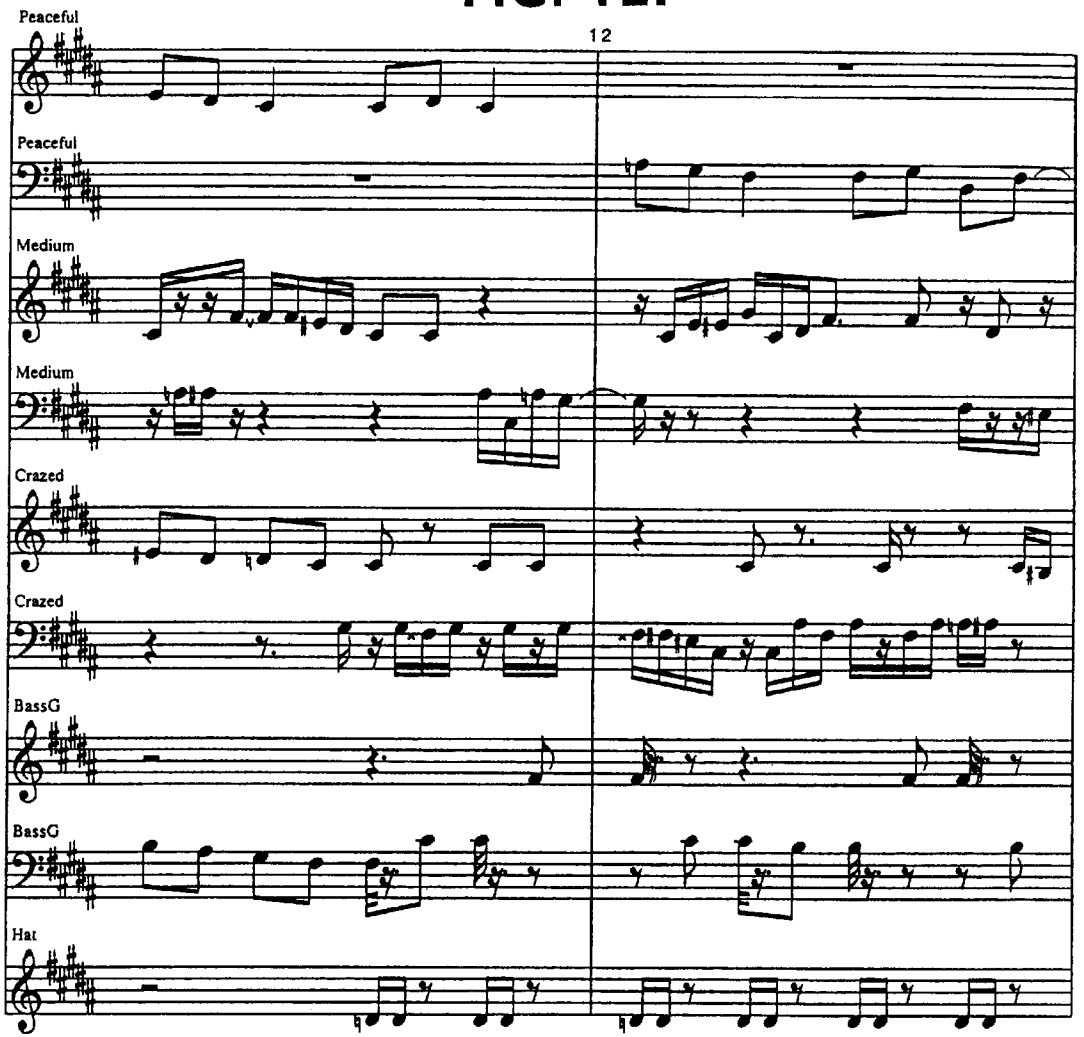
Figure 12G:
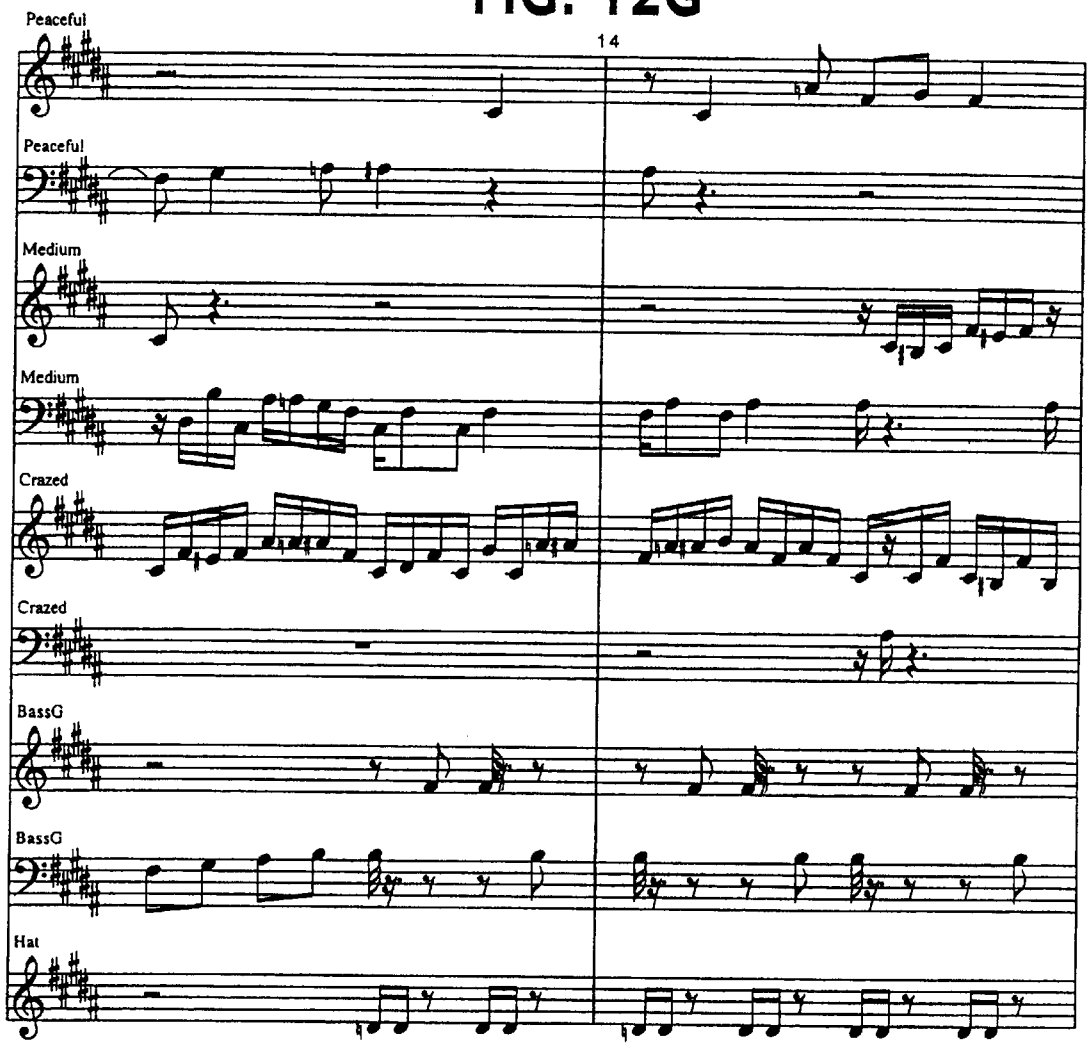
Figure 12H:
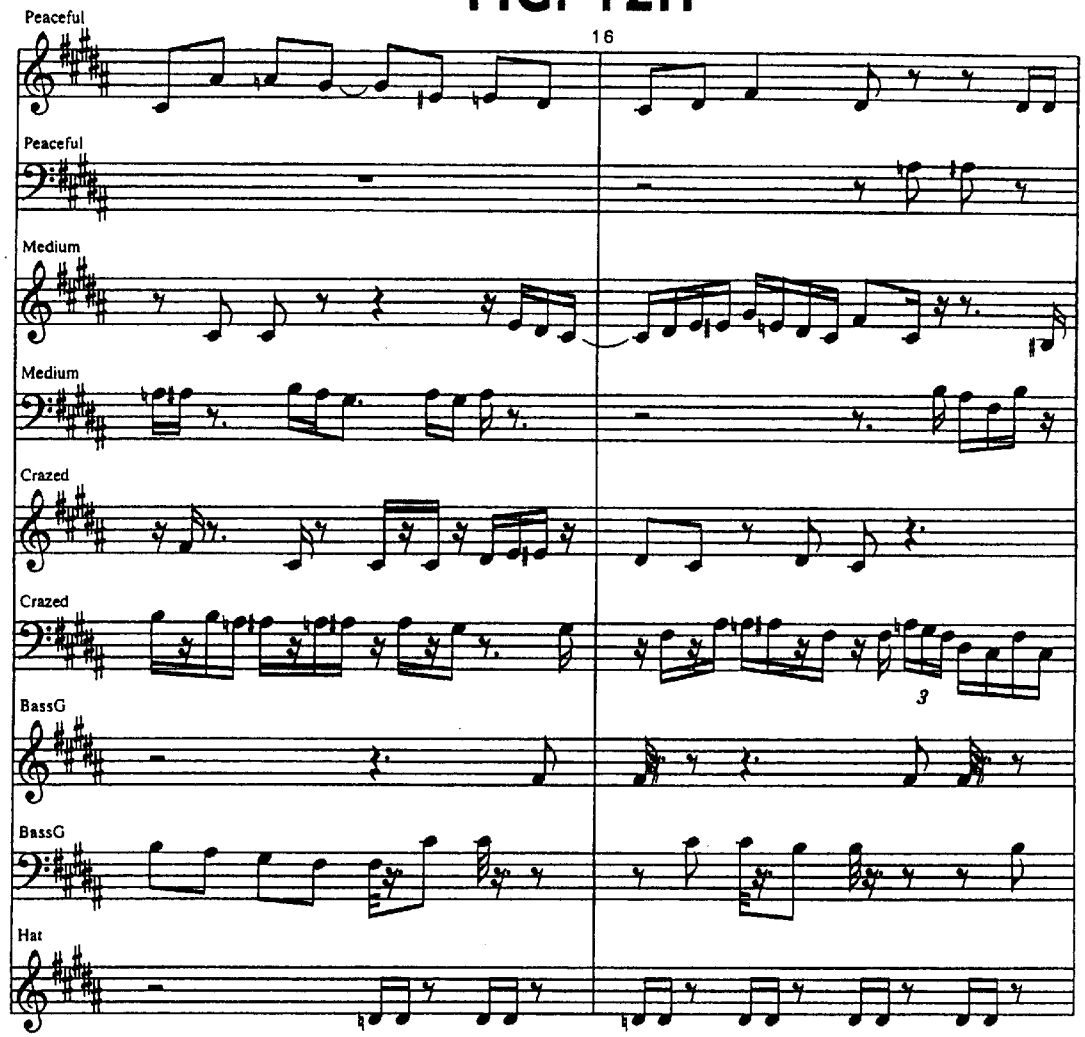
Figure 12I:
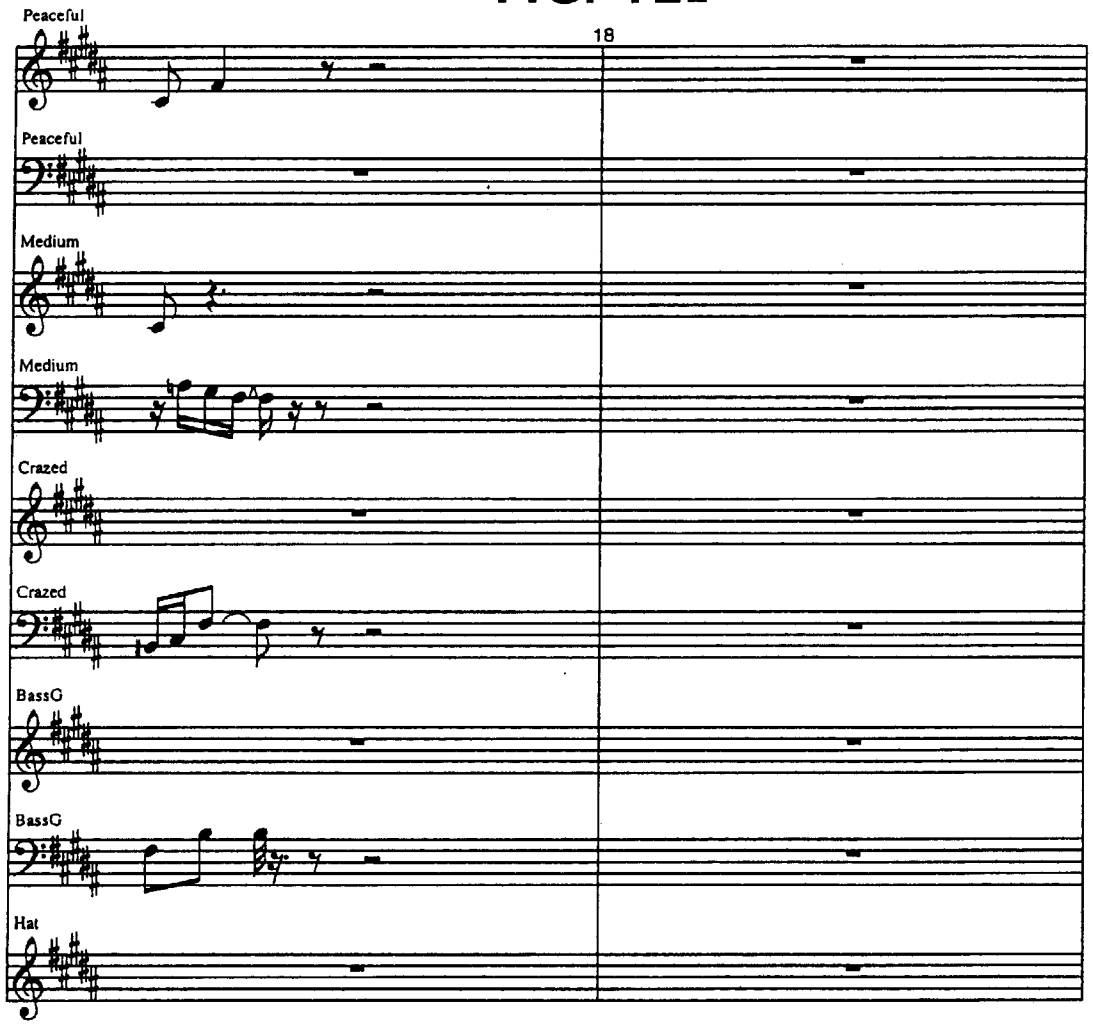

Each of the accompaniment selectors 100A, 100B, 100C, 100D, 100E corresponds to a different type of an accompaniment melody stored as audio content 74. An accompaniment melody is a vocal or instrument part having a succession of musical tones and that is background for an instrumental part. As illustrated in FIG. 4, the accompaniment selector 100A corresponds to a "classical" accompaniment, the accompaniment selector 100B corresponds to a "country" accompaniment, the accompaniment selector 100C corresponds to a "rock" accompaniment, the accompaniment selector 100D corresponds to a "world" accompaniment, and the accompaniment selector 100E corresponds to a "techno" accompaniment. As described further below, selection of one of the accompaniment melody selectors 100A, 100B, 100C, 100D, 100E sends a signal to the controller 30 indicating that the user has selected a specific accompaniment to be played by the musical drawing assembly 40. The controller 30 will then select an audio content 74 that corresponds to the accompaniment selector selected by the user. FIG. 10 illustrates five audio contents 74A, 74B, 74C, 74D, 74E. Audio content 74A corresponds to a classical accompaniment, audio content 74B corresponds to a country accompaniment, audio content 74C corresponds to a rock accompaniment, audio content 74D corresponds to a world accompaniment, and audio content 74E corresponds to a techno accompaniment. The controller 30 selects one of the audio contents 74A, 74B, 74C, 74D, 74E in response to a selection of one of the accompaniment melody selectors 100A, 100B. If a user selects, for example, the accompaniment selector 100A, a signal is sent to the controller, indicating the selection of the classical accompaniment melody. The controller 30 then determines which of the audio contents 74 corresponds to a classical accompaniment. Because audio content 74A is the classical accompaniment, the controller 30 selects audio content 74A for submission to the audio output generator 82. Although the above accompaniment melody styles or types are preferred, it will be appreciated that the musical drawing assembly 40 can play other accompaniment melody styles as well, such as jazz and funk accompaniments.

In the preferred embodiment, the accompaniment selectors 100A, 100B, 100C, 100D, 100E include pressure sensitive switches 133 identical in construction to the switches 132 of the sensor 130, described further below. Hence, the user of the musical drawing assembly 40 may select any of the accompaniments to be played by the musical drawing assembly 40 by pressing one of the accompaniment selectors 100A, 100B, 100C, 100D, 100E. In this manner, a user can choose one of many accompaniment melodies to be played by the musical drawing assembly 40. Selection of an accompaniment melody will also influence the instrument melody played by the musical drawing assembly 40, as described further below.

Instrument selectors 110A, 110B, 110C, 110D, 110E, 110F are selectors that permit the user to select one of many different instruments for instrumental melodies or instrument parts that are played by the musical drawing assembly 40 over the selected accompaniment melody. By selecting one of the instruments via one of the instrument selectors 110A, 110B, 110C, 110D, 110E, 110F, a signal is sent to the controller 30 indicating which instrument the user desires the musical drawing assembly 40 to play. The instrument selector 110A corresponds to a flute, the instrument selector 110B corresponds to a banjo, the instrument selector 110C corresponds to a guitar, the instrument selector 110D corresponds to an xylophone, the instrument selector 110E corresponds to a xylophone, and the instrument selector 110F corresponds to a piano. The musical drawing assembly may also present other instruments for selection by a user, such as a trumpet and saxophone.

For purposes of illustration, FIG. 10 depicts five audio content groups 74$A_1$, 74$B_1$, 74$C_1$, 74$D_1$, 74$E_1$, of five audio content groups that each include instrumental melodies which the controller 30 can select in response to a selection of one of the instrument selectors. The audio content group 74$A_1$ is a group of classical instrumentals, the audio content group 74$B_1$ is a group of country instrumentals, the audio content group 74$C_1$ is a group of rock instrumentals, the audio content group 74$D_1$ is a group of world instrumentals, and the audio content group 74$E_1$ is a group of techno instrumentals. Within each audio content group 74$A_1$, 74$B_1$, 74$C_1$, 74$D_1$, 74$E_1$, is a subset of audio contents. For example, within the audio content group 74$A_1$ is a subset of audio contents 74$A_{1a}$, 74$A_{1b}$, 74$A_{1c}$ of three different classical instrumental melodies. As described further below, audio contents 74$A_{1a}$, 74$A_{1b}$, 74$A_{1c}$ each respectively correspond to a "peaceful", "medium", and "crazed" instrumental melody for the selected accompaniment style.

As illustrated by FIG. 10, if a user selects, for example, the classical accompaniment and the instrument selector 110C, a signal is sent to the controller 30 indicating that the user desires the musical drawing assembly 40 to play a classical instrumental melody of a guitar. As described further below, the controller 30 then determines which of the audio contents 74 corresponds to a classical instrumental and selects one of the audio contents 74$A_{1a}$, 74$A_{1b}$, 74$A_{1c}$ for submission to the audio output generator 82. Hence, the control block 60 will select an audio content 74 that corresponds to the selected accompaniment. In the preferred embodiment illustrated in FIGS. 2 and 4, the instrumental selectors 110A, 110B, 110C, 110D, 110E, 110F are mechanical buttons that are pressed to send a signal or pulse to the control block 60. The preferred mechanical buttons include a silicone rubber cone with a carbon impregnated rubber button that creates a connection between two interleaved copper traces on a printed circuit board.

The volume control selector 202 illustrated in FIGS. 1, 2, and 4 is a selector by which the user of the musical drawing assembly can adjust the volume of any audible output of music outputted by the musical drawing assembly. As illustrated by FIG. 2, the volume selector is preferably a dual rotatable volume control dial. In an alternative embodiment, the volume control selector is a slide control.

Figure 3:
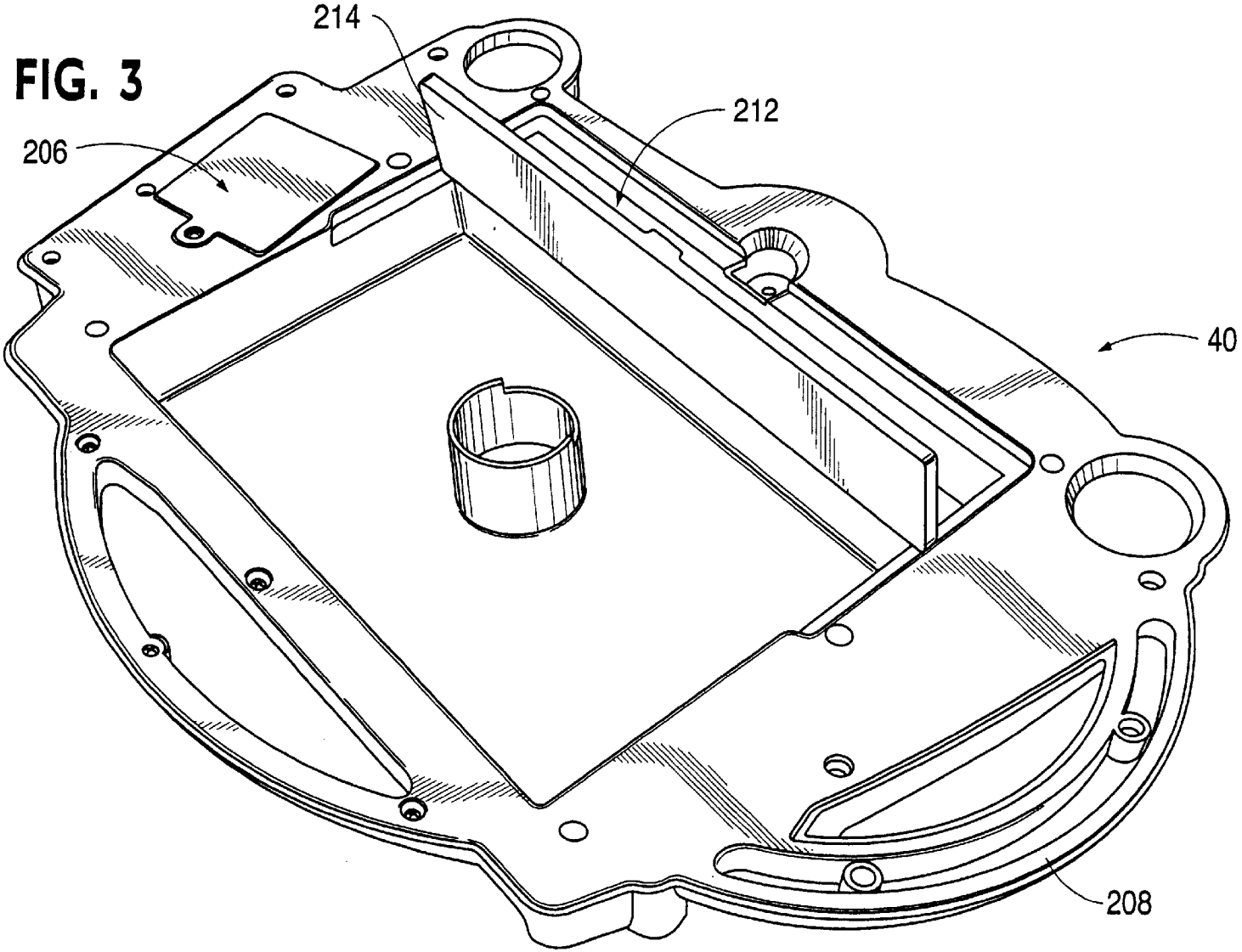
FIG. 3 is a rear perspective view of the musical drawing assembly illustrated in FIG. 2.

The on/off selector 204 of the user input block is a selector by which a user of the musical drawing assembly may turn on and off all the functional aspects of the musical drawing assembly 40. Hence, the musical drawing assembly 40 also includes a power unit, which in the preferred embodiment is a plurality of batteries stored in a battery case 206, as illustrated in FIG. 3.

The user input block 50 also includes the new song selector 206 through which the user indicates to the musical drawing assembly 40 that he or she desires to create a new song. The replay selector 120 permits the user to replay a composed musical composition, as described further below.

As illustrated in FIG. 1, the user input block 50 further includes the drawing sensor 130, which defines part of a drawing board 140. The drawing board 140 is a device on which the user creates drawing movement. Drawing movement may be created with any form of a stylus, which is any instrument used for inscribing, writing, marking, etching, etc. Examples of suitable styli include pens, pencils, crayons, markers, fingers, sticks, utensils, etc.

FIG. 2 illustrates the preferred embodiment of the drawing board 140. The drawing board 140 includes an external and rectangular surface 142 upon which the user can draw. The user may draw directly on the external surface 142 of the drawing board 140 (such as with an erasable felt marker or chalk), or may place a piece of paper or other item on top of the surface 142 and draw with a crayon, pencil, or other stylus. Additionally, the user may simply create drawing movement without leaving indicia of drawing, such as by creating drawing movement with a pointer or capped pen. In either scenario, it is considered that the user is creating drawing movement on the drawing board 140. If the user chooses to draw on a piece of paper, the user may hold the piece of paper to the musical drawing assembly 40 with the assistance of an easel clip 210. The easel clip 210 is a spring biased clip that holds the piece of paper to the musical drawing assembly casing 200. The musical drawing assembly also includes a stylus compartment 212 located on the backside of the musical drawing assembly 40. As illustrated in FIG. 3, the stylus compartment 212 includes a cover 214 that may be opened and closed so as to access or close-off the contents of the compartment 212. When a user desires to use a crayon or felt marker in the stylus compartment 212, the user opens the cover 214 to access the interior of the stylus compartment 212 and retrieve the stylus.

The preferred embodiment of the drawing sensor 130 is an array or matrix of pressure sensitive switches 132 located in the drawing board 140. The switches 132 close or short-circuit as a result of pressure applied to the surface of the drawing board 120. The drawing sensor 130 is formed from a two layer substrate, wherein the individual membrane switches 132 are formed by traces of conductive material, such as conductive ink traces, printed on the lower side of the upper substrate layer and the upper side of the lower substrate layer. One of the layers has a pattern of small insulative bumps numerous enough to keep the two layers, and hence the conductive traces, apart from each other. The conductive layers are thus separated from each other by air gaps at locations between the pattern of bumps, and the air gaps define the locations where the switches 132 are located. The substrates, in particular the upper substrate layer, are fabricated from a resilient material that is deformed by pressure contact. Hence, when pressure is exerted from a stylus at a location where the conductive traces are located at an area between the bumps, the upper layer deflects into the lower layer, thereby electrically connecting the conductive traces provided on the upper and lower substrates. When pressure from the stylus is removed, the upper substrate layer retracts to its normal position, thereby breaking the electrical contact between the conductive traces.

In an alternative embodiment of the musical drawing assembly 40, the drawing sensor is formed by a three-layer substrate, wherein the individual membrane switches are formed by traces of conductive ink printed on the lower side of the upper substrate layer and the upper side of the lower substrate layer. The center layer, however, is punched in various locations, such as in ½ inch circles, so as to provide air gaps between the conductive traces. The substrates, in particular the upper substrate layer, are fabricated from a resilient material that is deformed by pressure contact. Hence, when pressure is exerted from a stylus at a location where the center layer has been punched, the upper layer deflects into the lower layer, thereby electrically connecting the conductive traces provided on the upper and lower substrates. When pressure from the stylus is removed, the upper substrate layer retracts to its normal position, thereby breaking the electrical contact between the conductive traces. This alternative drawing sensor is similar to that described in U.S. Pat. No. 5,604,517, the entire disclosure of which is hereby incorporated by reference.

Figure 5A:
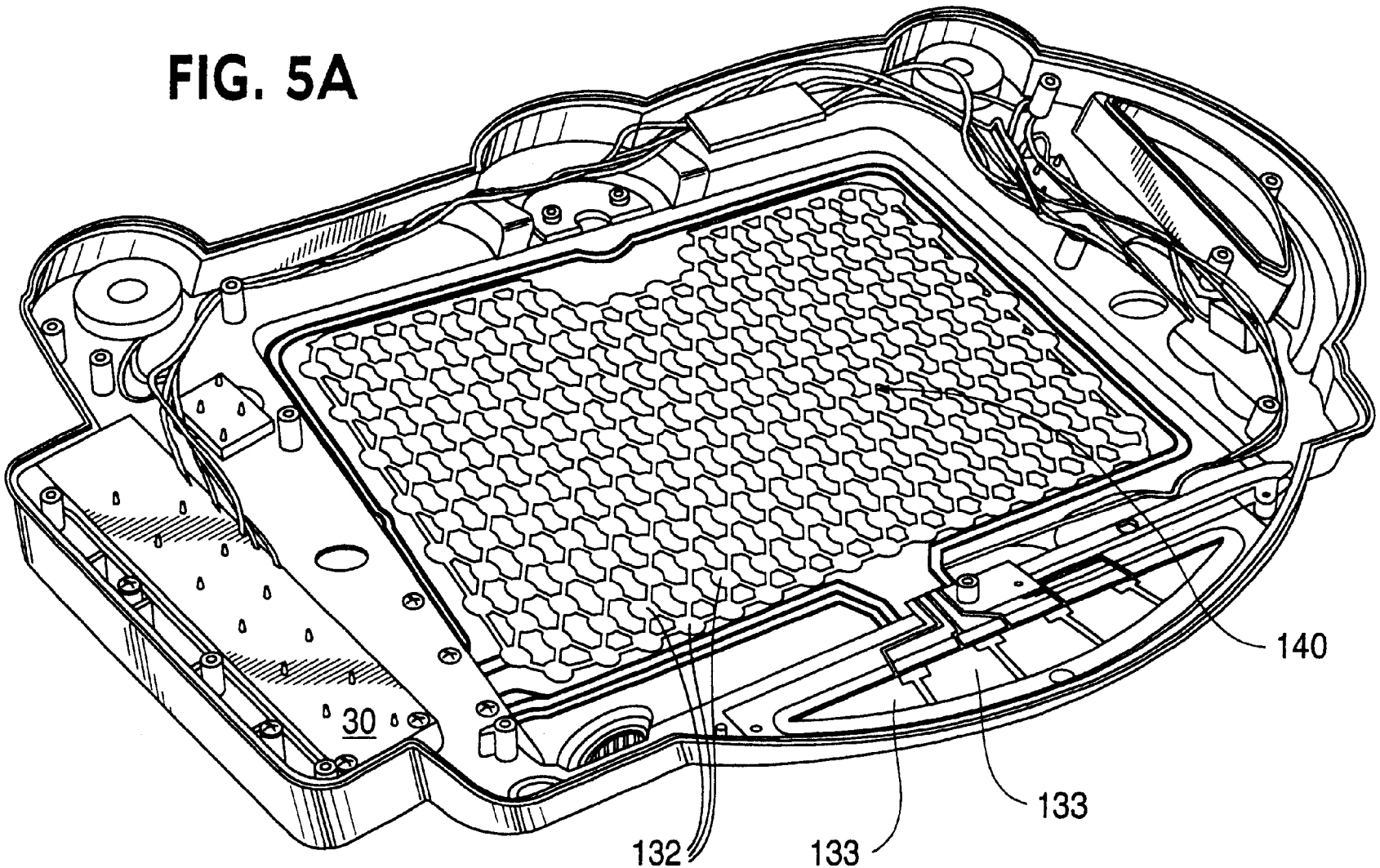
FIG. 5A is a perspective view of the musical drawing assembly illustrated in FIG. 2, where the backside of the drawing board is exposed.
Figure 5B:
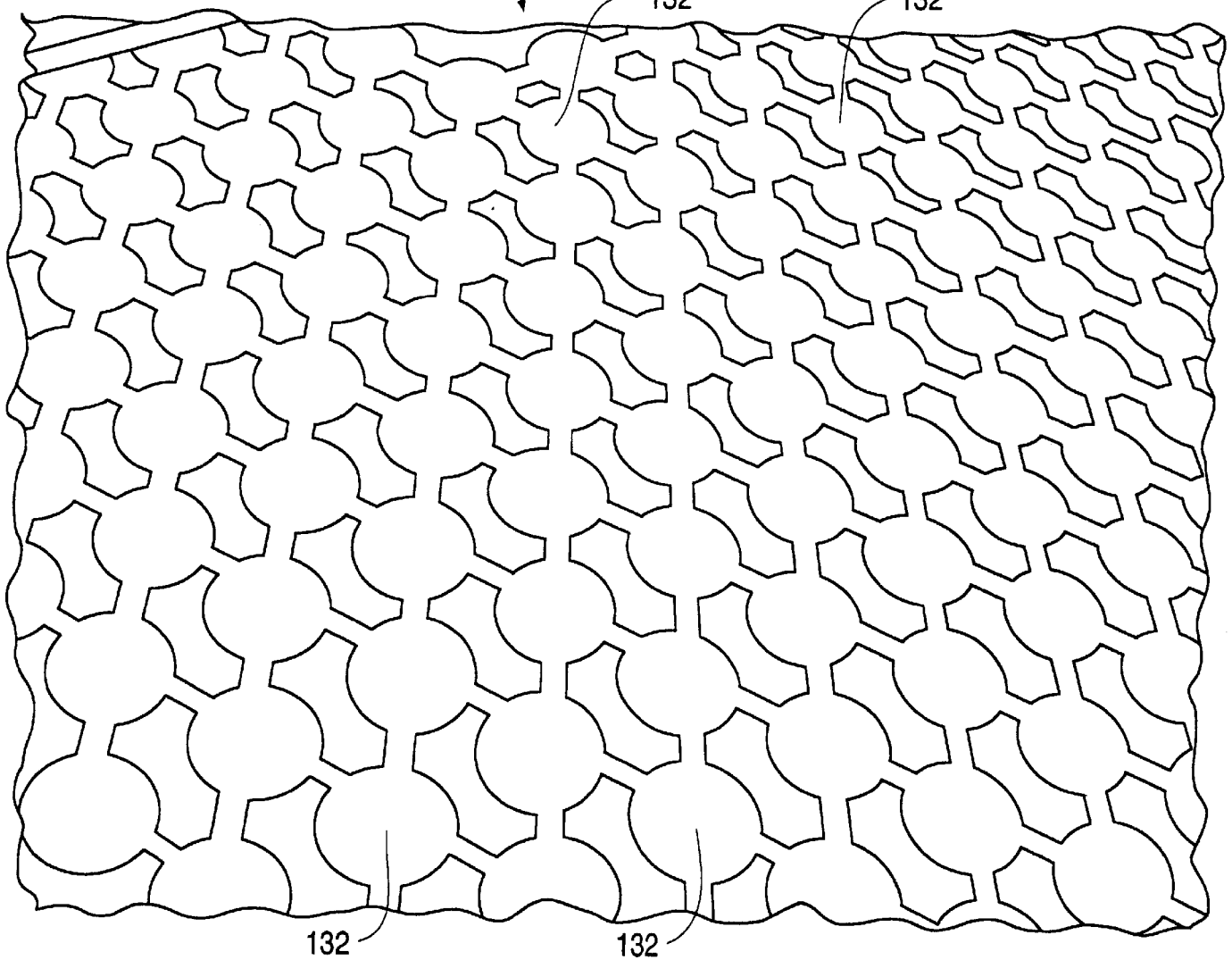
FIG. 5B is a perspective view of the drawing board of the musical drawing assembly illustrated in FIG. 5A.
Figure 6:
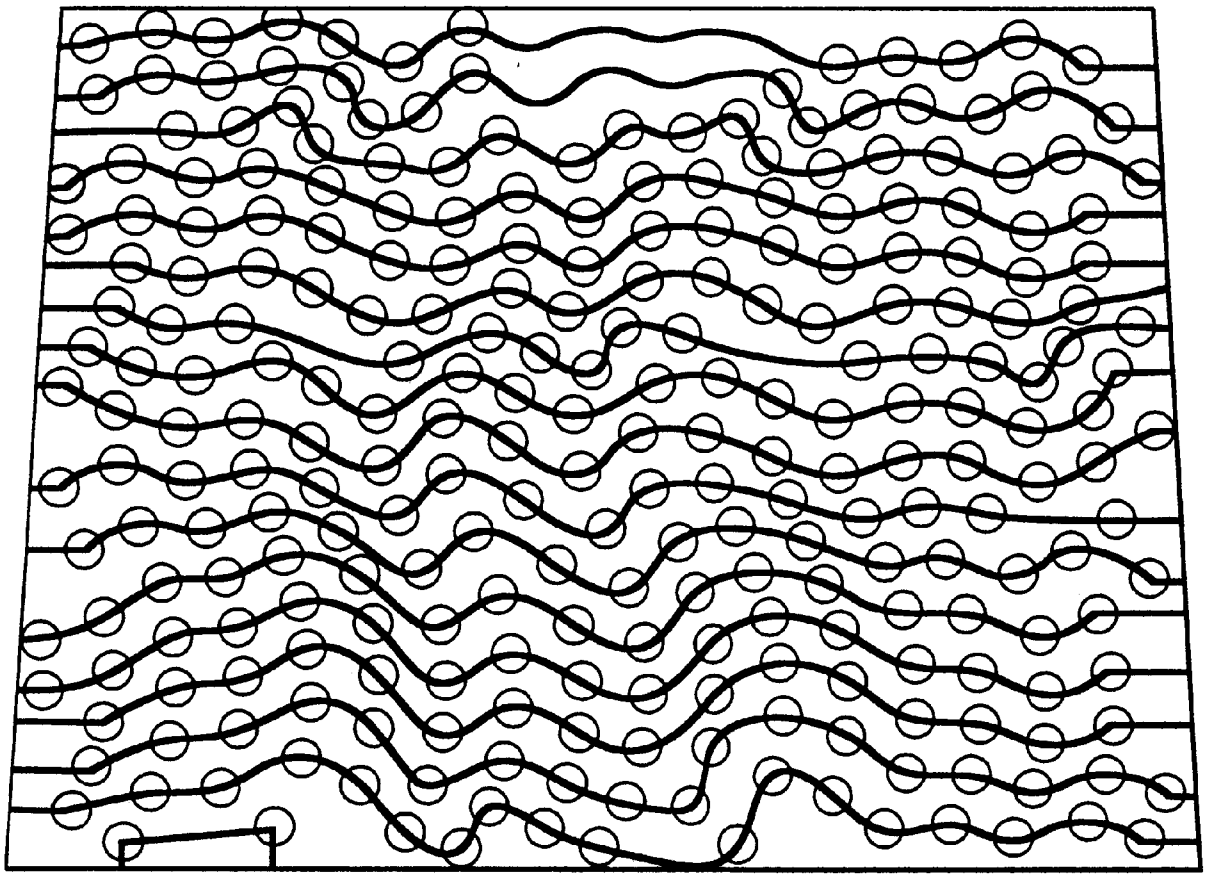
FIG. 6 is a perspective view of an alternative embodiment of a drawing board.
Figure 7:
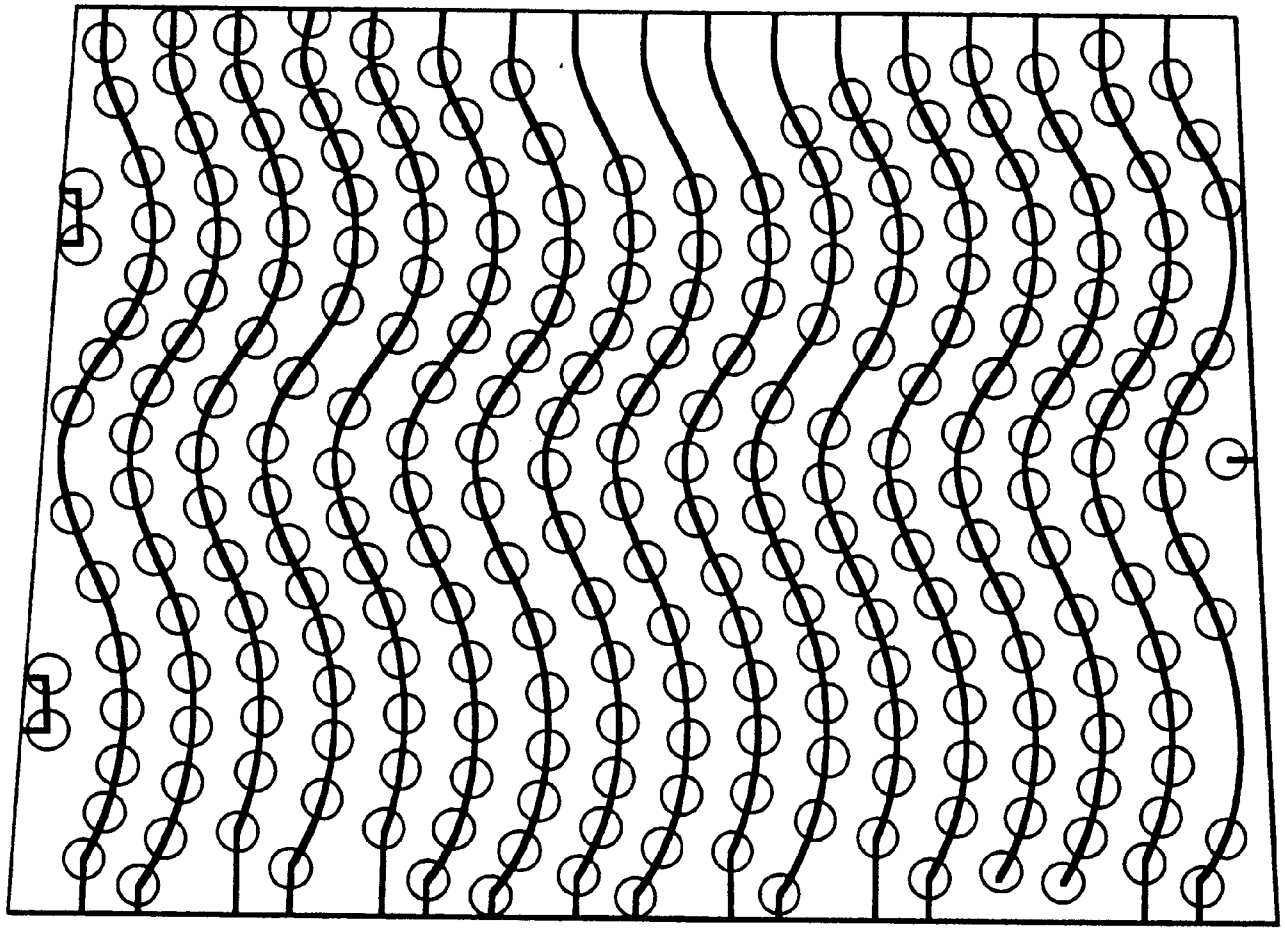
FIG. 7 is a perspective view of a further embodiment of a drawing board.
Figure 8:
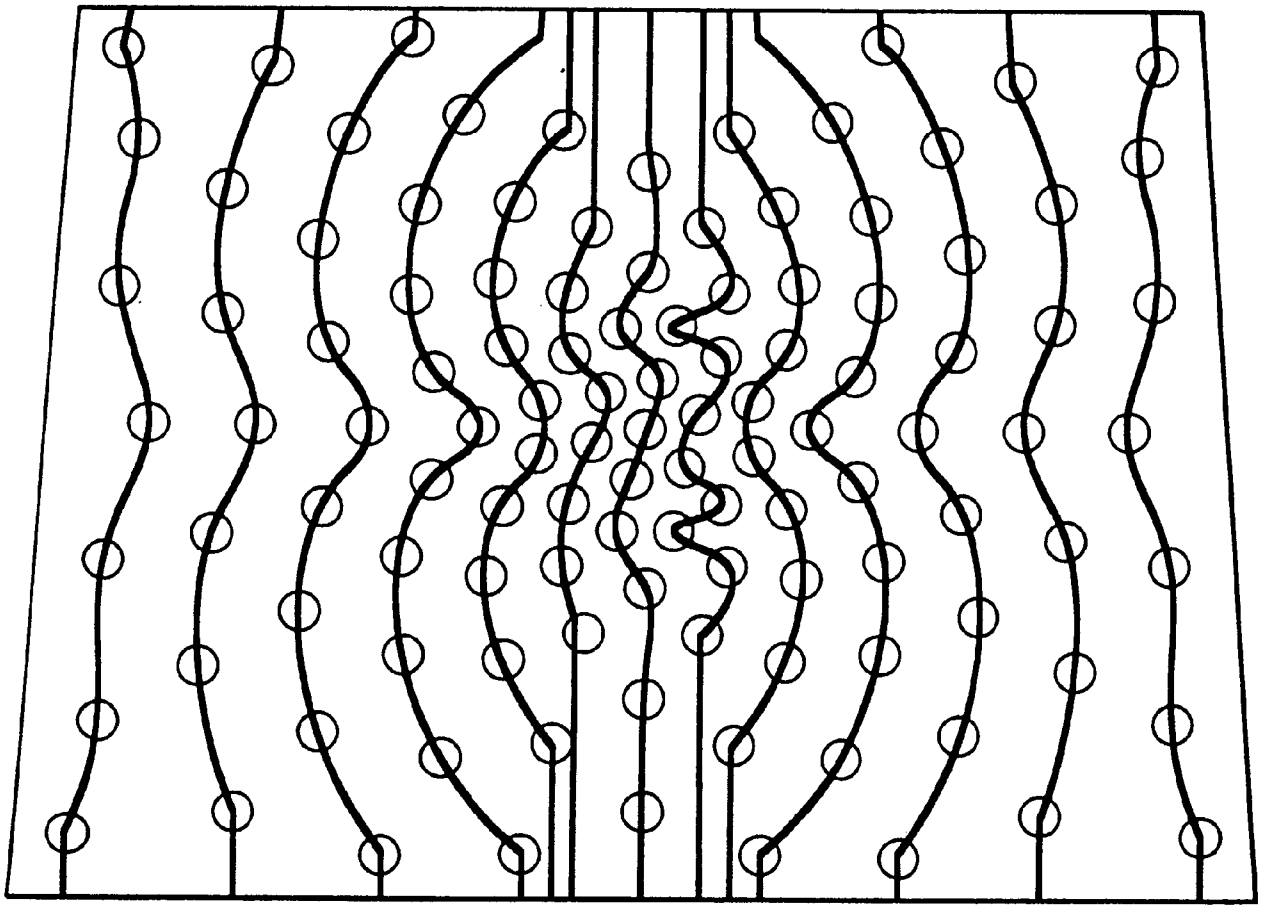
FIG. 8 is a perspective view of another embodiment of a drawing board.
Figure 9:
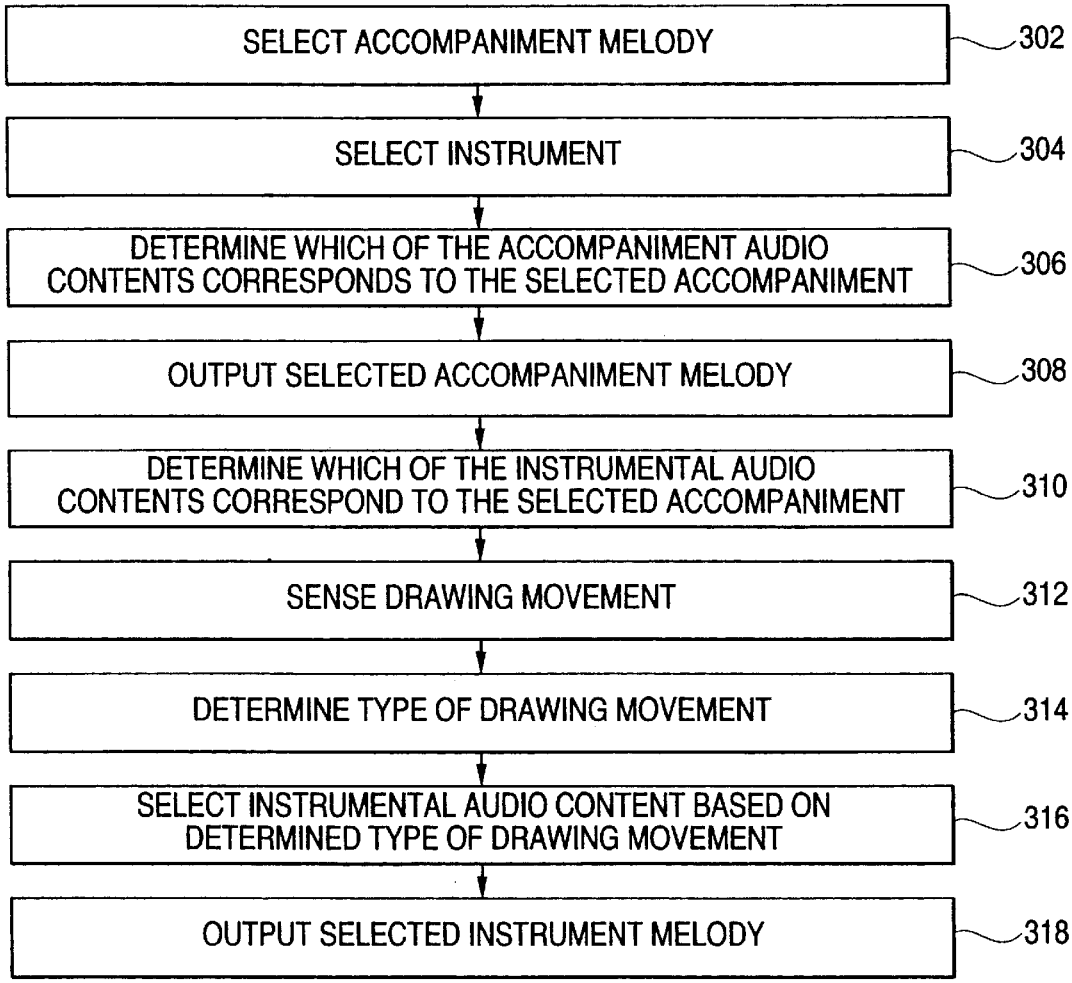
FIG. 9 is a flow chart illustrating the operation of the musical drawing assembly illustrated in FIGS. 2, 3 and 4.

Any pressure contact with the drawing sensor 130 that closes a succession of switches 132 is considered "drawing movement" as this term is used herein. When a user draws on the drawing board 140, the drawing sensor 130 senses the drawing movement and switches 132 generate signals which are received by the control block 60. To assist in detecting drawing movement, the switches 132 are located in a pattern across the surface 142 of the drawing board 140. In the preferred embodiment of the musical drawing assembly, the switches 132 are evenly disbursed about the surface of the drawing board 140, as illustrated in FIGS. 5A and 5B, which depict the back side of the drawing board 140. Each switch 132 is individually and electrically connected to the control block 60 such that whenever a stylus closes one of the switches 132, an electrical path is completed and a signal or pulse is sent to the controller 30. In this manner, one stroke of a stylus across the exterior surface 142 of the drawing board will close a number of switches 132 and a signal will be sent to the control block 60 for each closed switch. Although the pattern illustrated in FIGS. 5A and 5B is preferred, other patterns will also suffice, such as those illustrated in FIGS. 6–8. FIG. 6 illustrates a random distribution of the switches 132. FIG. 7 illustrates a wavy pattern of the switches 132, and FIG. 9 illustrates a pattern where the switches 132 are concentrated in the center of the drawing board 120. It will also be appreciated that other types of sensors, switches, and patterns will also suffice. For example, suitable drawing movement sensors include: sound emitters and detectors; strain gauge sensors; arrays of light emitters and detectors; micropower radar devices; conductive carbon covered membranes or screens, such as those used with interactive touch displays; and patterns of push, buttons.

The operation of the musical drawing assembly 40 will now be described in reference to the flow diagram illustrated in FIG. 9. To begin operating the musical drawing assembly 40, a user will first place a sheet of paper under the easel clip 210. Alternatively, the user can decide to draw directly on the exterior surface 142 of the drawing board 140, such as with a felt marker. In a further embodiment, the user creates drawing movement, but leaves no indicia of drawing movement, such as when the user draws with his or her index finger. The user will then turn on the musical drawing assembly 40 via depressing the on/off button selector 204 so as to provide power to the musical drawing assembly 40.

After the user has turned on the power to the musical drawing assembly 40, at step, 302, the user selects an accompaniment melody by actuating one of the accompaniment melody selectors 100A, 100B, 100C, 100D, 100E. For example, the user may depress accompaniment selector 100*a* because the user desires a classical composition having a classical accompaniment. The user then, at step 304, selects an instrument for a lead melody by depressing one of the instrument selectors 110A, 110B, 110C, 110D, 110E, 110F. For example, the user may depress instrument selector 110A because the user desires a flute instrumental to be played over the previously selected classical accompaniment.

Before or after the user has selected an instrument for a lead melody, the controller 30, at step 306, will then determine which of the audio content 74 is an accompaniment melody that corresponds to the selected accompaniment. FIG. 10 illustrates five audio contents 74A, 74B, 74B, 74C, 74D, 74E that are accompaniment melodies for classical and country musical styles. If the user selects the accompaniment selector 100A, the logic 62 of the control block 60 will recognize that the audio content 74A corresponds to the selected accompaniment music style and thus access the audio content 74A. If the user selects the accompaniment selector 100B, the logic 62 of the control block 60 will recognize that the audio content 74B corresponds to the selected accompaniment music style, i.e., country music.

After the controller 30 has determined which of the audio contents 74 is an accompaniment melody that corresponds the accompaniment selected by the user, at step 308, the controller 30 generates a signal with the signal generator 84 and outputs the accompaniment melody to at least one of the audio transducers 86A, 86B (in the preferred embodiment, the audio transducer 86B plays the accompaniment melody while the audio transducer 86A plays the instrumental melody). Hence, the controller 30 outputs the selected accompaniment melody to at least one of the audio transducers 86A, 86B such that the musical drawing assembly 40 plays the accompaniment melody. In the preferred embodiment, the controller 30 outputs the selected accompaniment melody as soon as the user selects one of the accompaniment melody selectors 100A, 100B, 100C, 100D, 100E. In an alternative embodiment, the controller 30 will not output the selected accompaniment melody until the drawing sensor 130 senses drawing movement on the drawing board 140. As described earlier, the controller will also select a video content 76 and output the video content 76 to the video output generator 88 when the accompaniment music is playing.

After the controller 30 has determined which of the accompaniment audio contents 74A, 74B, 74C, 74D, 74E corresponds to the selected accompaniment, the controller, at step 310 determines which of the instrumental audio contents 74$A_1$, 74$B_1$, 74$C_1$, 74$D_1$, 74$E_1$ corresponds to the selected accompaniment style. The audio content group 74$A_1$ corresponds to a group of classical instrumentals, the audio content group 74$B_1$ corresponds to a group of country instrumentals, the audio content group 74$C_1$ corresponds to a group of rock instrumentals, the audio content group 74$D_1$ corresponds to a group of world instrumentals, and the audio content group 74$E_1$ corresponds to a group of techno instrumentals.

In the preferred embodiment of the musical drawing assembly 40, each set of instrumental audio contents 74$A_1$, 74$B_1$, 74$C_1$, 74$D_1$, 74$E_1$ associated with a particular type of musical accompaniment includes three different audio contents (74$A_{1a}$, 74$A_{1b}$, 74$A_{1c}$, etc.). That is, the storage device 71 of the controller 30 stores three different instrumental audio contents for each accompaniment style selectable by the user. For example, as illustrated by FIG. 10, three different audio contents 74$A_{1a}$, 74$A_{1b}$, 74$A_{1c}$ are stored for classical instrumentals. Likewise, three different audio contents 74$B_{1a}$, 74$B_{1b}$, 74$B_{1c}$ are stored for a country instrumentals, three different audio contents 74$C_{1a}$, 74$C_{1b}$, 74$C_{1c}$ are stored for a rock instrumentals, etc. In alternative embodiments, the musical drawing assembly 40 includes only two instrumental audio contents 74 for each particular accompaniment melody style. In a further embodiment, the musical drawing assembly 40 includes five instrumental audio contents 74 for each particular accompaniment melody style.

Considering an example where the user selects the accompaniment selector 100A corresponding to a classical accompaniment, the controller 30 will determine that the audio contents 74$A_{1a}$, 74$A_{1b}$, 74$A_{1c}$, all correspond to a classical instrumental. That is, the controller 30 will determine that each audio contents 74$A_{1a}$, 74$A_{1b}$, 74$A_{1c}$ each correspond to classical instrumental melodies and that the remaining audio contents 74$B_{1a}$, 74$B_{1b}$, 74$B_{1c}$, etc. each correspond to non-classical instrumental melodies. Before selecting one of the audio contents 74$A_{1a}$, 74$A_{1b}$, 74$A_{1c}$, the drawing sensor 130, at step 312, will sense drawing movement on the drawing board 140 in the above-described manner. Hence, the controller 30 will not select one of the audio contents 74$A_{1a}$, 74$A_{1b}$, 74$A_{1c}$ that each correspond to a classical instrumental melody until the drawing sensor 130 senses drawing movement on the drawing board 140.

After the drawing sensor 130 senses drawing movement, at step 314, the controller 30 determines a "type" of drawing movement based on the output from the drawing sensor 130. Examples of types of drawing movement include speeds and accelerations of drawing movement. Control block 60 may determine that the sensed drawing movement is above, below, or equal to a predetermined speed or acceleration. In the preferred embodiment, the control block 60 determines whether the sensed drawing movement is within one of three predetermined speed ranges; in this case, the types of drawing movement are "peaceful" drawing movement speeds, "medium" drawing movement speeds, and "crazed" drawing movement speeds.

The controller 30 determines the speed of drawing movement by measuring the amount of time between successive pulses (two or more) received from the drawing sensor 130 and then determining which of three predetermined time ranges the measured time falls within. Considering the example where the user selected the classical accompaniment, each one of the audio contents 74$A_{1a}$, 74$A_{1b}$, 74$A_{1c}$ corresponds to one of the predetermined ranges. If the amount of time between successive pulses is within a first predetermined range (preferably 167 milliseconds or greater), the controller determines that the user is generating drawing movement at the "peaceful" rate and will thus selects audio content 74$A_{1a}$. If the amount of time between successive pulses is within a second range (preferably between 150 milliseconds and 166 milliseconds), the controller 30 determines that the rate of drawing movement is at the "medium" rate and thus selects the audio content 74$A_{1b}$. If the controller determines that the time between successive pulses from the drawing sensor 130 is within a third range (less than 150 milliseconds), the controller 30 determines that the rate of drawing movement is at the "crazed" rate and thus selects audio content 74$A_{1c}$. In this manner, the controller 30 determines the type of drawing movement by the user, and, at step 314, selects one of the audio contents, such as the exemplary audio contents 74$A_{1a}$, 74$A_{1b}$, 74$A_{1c}$corresponding to classical instrumentals, based on the type of drawing movement.

As will be appreciated, the previously-described ranges can be varied to change the thresholds between peaceful, medium, and crazed drawing movement speeds. Additionally, it will be realized that any step of determining the time between pulses or determining the number of pulses within a given time period is considered "determining the speed of drawing movement" even though the actual numerical value of drawing movement speed is not calculated. Hence, each of the ranges used for selecting one of the instrumental melodies within one of the audio content groups 74$A_1$, 74$B_1$, 74$C_1$, 74$D_1$, 74$E_1$ may be: (1) a time between pulses from the sensor 130; (2) a number of pulses for a predetermined period of time; or (3) a range of numerical drawing speed values calculated from the foregoing information. Based upon the determined type of drawing movement, the control block 60 will select a sensible output content 72 to be output to the sensible output generator 80.

Before the controller 30 selects the appropriate audio content for the determined type of drawing movement, at step 304, the user has already selected an instrument for a lead melody by depressing one of the instrument selectors 110A, 110B, 110C, 110D, 110E, 110F. By depressing one of the selectors 110A, 110B, 110C, 110D, 110E, 110F, the controller 30 recognizes that the user desires to create an instrumental melody for the particular musical style corresponding to the selected musical accompaniment and, thus, at step 310, determines the audio content 74 that corresponds to the selected musical instrument. As illustrated by FIG. 10, the audio content includes six instrumental audio contents 74F, 74G, 74H, 74I, 74J, 74K that each correspond to a different musical instrument, namely those provided for selection by instrument selectors 110A, 110B, 110C, 110D, 110E, 110F. Hence, instrumental audio content 74F corresponds to a flute, instrumental audio content 74G corresponds to a banjo, instrumental audio content 74H corresponds to a guitar, instrumental audio content 74I corresponds to a xylophone, instrumental audio content 74J corresponds to an electric bass, and instrumental audio content 74K corresponds to a piano.

Considering the example where the user selects the classical accompaniment and then selects the flute instrument selector 110A, the controller 30 will determine that the audio content 74F, rather than the audio contents 74G–K, corresponds to a flute. Assuming that the controller has selected the instrumental audio content $\mathbf{74}A_{1a}$ corresponding to a peaceful classical instrumental and has determined that the instrumental audio content 74F corresponds to the selected instrument, the controller, at step 318, outputs a classical flute instrumental to at least one of the audio transducers 83A, 83B such that the instrumental melody is played over the accompaniment melody. In this manner, the musical drawing assembly 40 can be controlled, by a user to creatively play the selected accompaniment melody and then play various different instrumental melodies over the accompaniment melody. The user of the musical drawing assembly 40 can thus create music having both an instrumental lead and musical accompaniment, dependent upon how quickly or slowly the user moves the stylus on the drawing board 140.

In an embodiment of the musical drawing assembly 40, the accompaniment audio contents 74A, 74B, 74C, 74D, 74E are stored in audio digital files, such as real audio, liquid audio, MP3, MPEG, and, preferably, wave files. In the preferred embodiment, these audio files for the accompaniment audio contents 74A, 74B, 74C, 74D, 74E each include an entire score of an accompaniment melody that is played continuously and repeatedly while a specific accompaniment is selected. On the other hand, files for instrumental audio contents 74F, 74G, 74H, 75I, 74J, 74K are also audio digital files, such as wave files, but do not include the entire score of an instrumental melody of a particular instrument. Rather, the files for audio contents 74F, 74G, 74H, 75I, 74J, 74K each include one or two samples of the respective musical instrument, which are modified by the controller 30 based on the content of one of the audio contents $\mathbf{74}A_{1a}$, $\mathbf{74}A_{1b}$, $\mathbf{74}A_{1c}$, $\mathbf{74}B_{1a}$, etc. That is, the files for each of the audio contents $\mathbf{74}A_{1a}$, $\mathbf{74}A_{1b}$, $\mathbf{74}A_{1c}$, $\mathbf{74}B_{1a}$, etc. are control or data files, such as MIDI files, that store: the definition or description of instrumental notes to be played; the time definition of when to play notes; frequency shifting data, variables, or algorithms; and attack and decay definitions. Instrumental files for each of the audio contents $\mathbf{74}A_{1a}$, $\mathbf{74}A_{1b}$, $\mathbf{74}A_{1c}$, $\mathbf{74}B_{1a}$, etc. can also store other definitions as well, such as reverb and echo. Based on the control information stored in one of the instrumental files for each of the audio contents $\mathbf{74}A_{1a}$, $\mathbf{74}A_{1b}$, $\mathbf{74}A_{1c}$, $\mathbf{74}B_{1a}$, etc., the controller modifies the instrument sample in one of the audio contents 74F, 74G, 74H, 74I, 74J, 74K. In this manner, any one of the audio contents $\mathbf{74}A_{1a}$, $\mathbf{74}A_{1b}$, $\mathbf{74}A_{1c}$, $\mathbf{74}B_{1a}$, etc. and any one of the audio contents 74F, 74G, 74H, 74I, 74J, 74K can be used by the controller to produce an instrumental melody corresponding to the selected musical instrument and selected accompaniment musical style. For example, if the user selected the classical accompaniment and a flute instrumental, and the controller 30 senses crazed drawing movement, the controller would repeatedly modify the frequency, amplitude, and duration of the sample in the audio content 74F based on the content of the audio file $\mathbf{74}A_{1c}$ to output a crazed instrumental of a flute. This is considered as the controller 30 outputting the selected audio contents $\mathbf{74}A_{1c}$ and 74F to produce the desired instrumental melody. However, if the user selected the classical accompaniment and a banjo instrumental, and the controller 30 sensed crazed drawing movement, the controller would repeatedly modify the frequency, amplitude, and duration of the sample in the audio content 74G based on the same content of the audio file $\mathbf{74}A_{1c}$ to output a crazed instrumental of a banjo. This is considered as the controller 30 outputting the selected audio content $\mathbf{74}A_{1c}$ and 74G to produce the desired instrumental melody.

FIGS. 11 and 12 illustrate two different musical scores for the audio content 74. FIG. 11 illustrates the score for classical music, while FIG. 12 illustrates the score for "world or reggae" music. The classical musical score includes a "peaceful" instrumental melody 402, a "medium" instrumental melody 404, and a "crazed" instrumental melody 406. The classical instrumental melodies 402, 404, 406 thus correspond to audio contents $\mathbf{74}A_{1a}$, $\mathbf{74}A_{1b}$, $\mathbf{74}A_{1c}$, $\mathbf{74}B_{1a}$, $\mathbf{74}B_{1b}$, $\mathbf{74}B_{1c}$, etc. and are stored in storage device 71. As will be appreciated from FIGS. 10 and 11, the same classical instrumental melodies 402, 404, 406 are played for each selected musical instrument, except the instrument type is changed for the different musical instruments based on the content of audio contents 74F, 74G, 74H, 74I, 74J, 74K. Hence, if the user selects the classical accompaniment and the flute instrumental as described earlier, the controller 30 will select the audio content 74F and one of audio contents $\mathbf{74}A_{1a}$, $\mathbf{74}A_{1b}$, $\mathbf{74}A_{1c}$; based on these selections, the musical drawing assembly 40 will play one of the flute instrumental melodies 402, 404, 406, dependent upon the type of drawing movement sensed by the sensor 130. However, if the user selects a piano instrumental while the classical accompaniment is played, the controller 30 selects the audio content 74K and one of the audio contents $\mathbf{74}A_{1a}$, $\mathbf{74}A_{1b}$, $\mathbf{74}A_{1c}$ so as to play one of the classical piano instrumental melodies 402, 404, 406, dependent upon the type of drawing movement sensed by the sensor 130. Hence, for any given peaceful, medium, or crazed melody, the classical piano instrumental melodies and the classical flute instrumental melodies include the same succession of musical notes, except they differ in that the instrument changes. For example, the classical instrument melody for a flute is the same as the classical instrumental melody for an electric bass (they have the same succession of musical notes, as illustrated by melody 402), but the instrument for each audio content is different.

Audio content 74A corresponds to the classical accompaniment 400 and includes only a bass line for a cello. As will be appreciated from FIG. 11, the melodies 400, 402, 404, 406 are all at the same tempo (¼=100 BPM), and each have a different succession of musical notes. This is true for the instrumentals of each of the accompaniment music styles. Hence, the user of the musical drawing assembly 40 can create a classical composition that has a number of different lead instrumentals over a common classical accompaniment. This stimulates creativity and development, especially in infants who use the musical drawing assembly to create music.

FIG. 12 illustrates the musical score for country music. In contrast with the classical musical score illustrated in FIG. 11, the musical score for country music includes a complex accompaniment. The accompaniment 500 for country music includes three different melodies combined to produce the country accompaniment. The three different melodies may be saved in a common audio content 74B or may be saved in separate audio contents and played simultaneously by the musical drawing assembly 40. Similar to the classical score, the country score includes a "peaceful" instrumental melody 502, a "medium" instrumental melody 504, and a "crazed" instrumental melody 506. The country instrumental melodies 502, 504, 506 are stored in audio content group 74$B_1$, and each include a bass line and a treble line. The audio content 74$B_{1a}$ corresponds to the instrument melody 502. The audio content 74$B_{1b}$ corresponds to the instrument melody 504, and the audio contents 74$B_{1c}$ correspond to the instrument melody 506. As will be appreciated upon reviewing FIGS. 11 and 12, the melodies 400, 402, 404, 406 are each different from the melodies 500, 502, 504, 506 because they each have a different succession of musical notes.

Figure 13:
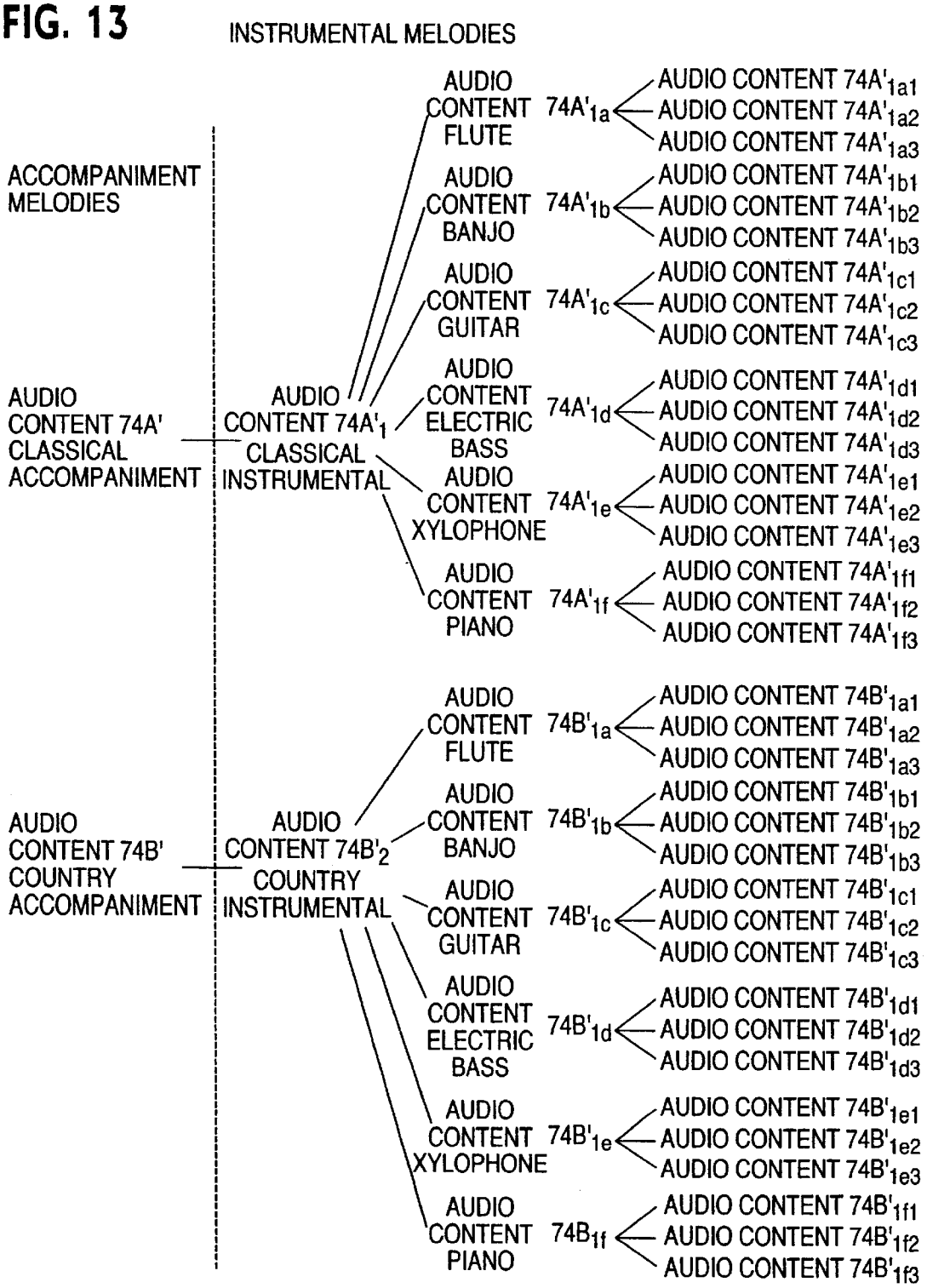
FIG. 13 is a schematic illustration of accompaniment and instrumental audio contents in accordance with an alternative embodiment of the present invention.
Figure 14:
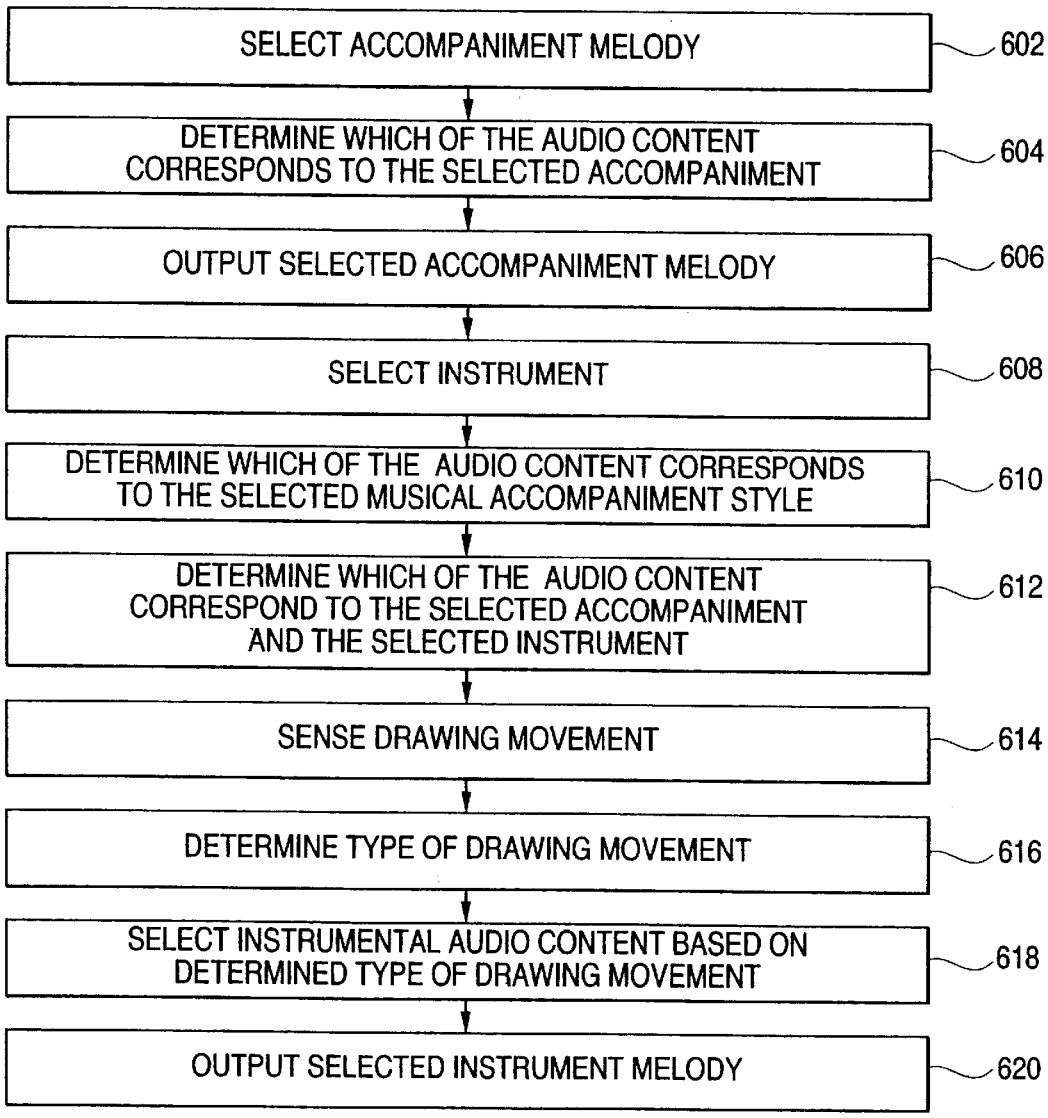
FIG. 14 is a flow chart illustrating the operation of the musical drawing assembly in accordance with an alternative embodiment of the present invention.

An alternative embodiment of the present invention is illustrated in FIG. 13 and described in reference to the flow diagram illustrated in FIG. 14. After the user has turned on the power to the musical drawing assembly 40, at step 602, the user selects an accompaniment melody by actuating one of the accompaniment melody selectors 100A, 100B, 100C, 100D, 100E. For example, the user may depress accompaniment selector 100A because the user desires a classical composition having a classical accompaniment.

The controller 30, at step 604, will then determine which of the audio content 74 is an accompaniment melody that corresponds to the selected accompaniment. FIG. 10 illustrates five audio contents 74A', 74B', 74B', 74C', 74D', 74E' that are accompaniment melodies for classical and country musical styles. If the user selects the accompaniment selector 100A, the logic 62 of the control block 60 will recognize that the audio content 74A' corresponds to the selected accompaniment music style and thus access the audio content 74A'. If the user selects the accompaniment selector 100B, the logic 62 of the control block 60 will recognize that the audio content 74B' corresponds to the selected accompaniment music style, i.e., country music.

After the controller 30 has determined which of the audio contents 74' is an accompaniment melody that corresponds the accompaniment selected by the user, at step 308, the controller 30 generates a signal with the signal generator 84 and outputs the accompaniment melody to at least one of the audio transducers 86A, 86B. Hence, the controller 30 outputs the selected accompaniment melody to at least one of the audio transducers 86A, 86B such that the musical drawing assembly 40 plays the accompaniment melody.

FIG. 13 depicts two audio content groups 74$A'_1$, 74$B'_2$ of five audio content groups that each include instrumental melodies which the controller 30 can select in response to a selection of one of the instrument selectors. The audio content group 74$A'_1$ is a group of classical instrumentals, while the audit content group 74$B'_2$ is a group of country instrumentals. Within each audio content group 74$A'_1$, 74$A'_2$, is a subset of audio contents 74$A'_{1a}$, 74$A'_{1b}$, 74$A'_{1c}$, 74$A'_{1d}$, 74$A'_{1e}$, 74$A'_{1f}$ of classical instrumental melodies for each selectable musical instrument. Additionally, within each subset of audio contents, 74$A'_{1a}$, 74$A'_{1b}$, etc., is a bundle of audio contents, such as audio contents 74$A'_{1a1}$, 74$A'_{1a2}$, 74$A'_{1a3}$, of classical instrumental melodies of a particular musical instrument (See FIG. 13). As described further below, audio contents 74$A'_{1a1}$, 74$A'_{1a2}$, 74$A'_{1a3}$, etc., each respectively correspond to a "peaceful", "medium", and "crazed" instrumental melody for a selected instrument and for the selected accompaniment style.

As illustrated by FIG. 10, if a user selects, for example, the classical accompaniment and the instrument selector 110E, a signal is sent to the controller 30 indicating that the user desires the musical drawing assembly 40 to play a classical instrumental melody of an electric bass. As described further below, the controller 30 then determines which of the audio contents 74' corresponds to a classical instrumental by an electric bass and selects one of the audio contents of the subset 74$A'_{1d}$ for submission to the audio output generator 82. Hence, the control block 60 will select an audio content 74' that corresponds to the selected accompaniment and the instrument selected by the user.

At step 608, the, user then selects an instrument for a lead melody by depressing one of the instrument selectors 110A, 110B, 110C, 110D, 110E, 11OF. For example, the user may depress instrument selector 110A because the user desires a flute instrumental to be played over the previously selected classical accompaniment. By depressing the selector 110A, the controller 30 recognizes that the user desires to create an instrumental melody for the particular musical style corresponding to the selected musical accompaniment and, thus, at step 610, determines the audio content 74' that corresponds to the selected musical accompaniment style. For example, if the user selected the classical accompaniment and then selects the flute instrument selector 110A, the controller 30 will determine that the group of audio content 74$A'_1$, rather than the group of audio content 74$B'_1$, corresponds to instrumentals for a classical accompaniment.

By pressing the selector 110A, the controller 30 also recognizes that the user desires a flute instrumental melody and, thus, at step 612, determines which of the audio content 74$A'_1$ that corresponds to the selected classical accompaniment also corresponds to the flute instrument selected by the user. FIG. 13 illustrates six groups of audio contents 74$A'_{1a}$, 74$A'_{1b}$, 74$A'_{1c}$, 74$A'_{1d}$, 74$A'_{1e}$, 74$A'_{1f}$ that are instrumental melodies that all correspond to the classical accompaniment. However, only the audio content set 74$A'_{1a}$ corresponds to a classical accompaniment and also corresponds to a flute instrumental. Hence, the controller 30, at step 612, determines that the audio content of the set 74$A'_{1a}$ corresponds to a classical accompaniment and also corresponds to a flute instrumental. That is, if the user selects the selector 110A, which corresponds to a flute instrumental, the logic 62 of the control block 60 will recognize that the audio content of the set 74$A'_{1a}$ corresponds to the selected flute instrument and will thus access the audio contents of the set 74$A'_{1a}$.

In this embodiment of the musical drawing assembly 40, each set of audio content 74$A'_{1a}$, 74$A'_{1b}$, 74$A'_{1c}$, 74$A'_{1d}$, 74$A'_{1e}$, 74$A'_{1f}$ associated with a particular musical instrument includes three different audio contents (74$A'_{1a1}$, 74$A'_{1a2}$, 74$A'_{1a3}$, etc.). That is, the storage device,71 of the controller 30 stores three different audio contents for each instrument selected by the user and which each correspond to a particular accompaniment. For example, as illustrated by FIG. 13, three different audio contents 74$A'_{1a1}$, 74$A'_{1a2}$, 74$A'_{1a3}$ are stored for a classical flute instrumental. Likewise, three different audio contents 74$A'_{1b1}$, 74$A'_{1b2}$, 74$A'_{1b3}$ are stored for a classical banjo instrumental, three different audio contents 74$A'_{1c1}$, 74$A'_{1c2}$, 74$A'_{1c3}$ are stored for a classical guitar instrumental, etc. In alternative embodiments, the musical drawing assembly 40 includes only two instrumental audio contents 74' for each particular instrument and accompaniment melody style. In a further embodiment, the musical drawing assembly 40 includes five instrumental audio contents 74' for each particular instrument and accompaniment melody style.

Considering an example where the user selects the instrument selector 110A corresponding to a flute, the controller 30 will determine that the bundle of audio content 74$A'_{1a1}$,

74A'$_{1a2}$, 74A'$_{1a3}$ all correspond to a classical flute instrumental. That is, the controller 30 will determine that each audio contents 74A'$_{1a1}$, 74A'$_{1a2}$, 74A'$_{1a3}$ is an instrumental melody by a flute and that the remaining audio contents 74A'$_{1b1}$, 74A'$_{1b2}$, 74A'$_{1b3}$, etc. are classical instrumental melodies by an instrument other than a flute. Before selecting one of the audio contents 74A'$_{1a1}$, 74A'$_{1a2}$, 74A'$_{1a3}$, the drawing sensor 130, at step 614, will sense drawing movement on the drawing board 140 in the above-described manner. Hence, the controller 30 will not select one of the audio content 74A'$_{1a1}$, 74A'$_{1a2}$, 74A'$_{1a3}$ that each correspond to a classical flute instrumental until the drawing sensor 130 senses drawing movement on the drawing board 140.

After the drawing sensor 130 senses drawing movement, at step 616, the controller 30 determines a "type" of drawing movement based on the output from the drawing sensor 130, as described above. Considering the example where the user selected the classical accompaniment and a flute instrumental, each one of the audio contents 74A'$_{1a1}$, 74A'$_{1a2}$, 74A'$_{1a3}$ corresponds to one of the predetermined ranges. If the amount of time between successive pulses is within a first predetermined range, the controller determines that the user is generating drawing movement at the "peaceful" rate and will thus selects audio content 74A'$_{1a1}$. If the amount of time between successive pulses is within a second, the controller 30 determines that the rate of drawing movement is at the "medium" rate and thus selects the audio content 74A'$_{1a2}$. If the controller determines that the time between successive pulses from the drawing sensor 130 is within a third range, the controller 30 determines that the rate of drawing movement is at the "crazed" rate and thus selects audio content 74A'$_{1a3}$. In this manner, the controller 30 determines the type of drawing movement by the user, and, at step 618, selects one of the audio contents, such as the exemplary audio contents 74A'$_{1a1}$, 74A'$_{1a2}$, 74A'$_{1a3}$ corresponding to classical flute instrumentals, based on the type of drawing movement.

After the controller 30 has selected the appropriate audio content for the determined type of drawing movement, the controller 30, at step 620, will output the selected audio file to the audio transducers 83A, 83B such that the instrumental melody is played over the accompaniment melody. In this embodiment of the musical drawing assembly 40, all the audio contents 74' illustrated in FIG. 13 are stored in audio digital files, such as real audio, liquid audio, MP3, MPEG, and wave files.

During the creation of music with the musical drawing assembly 40, if the user presses one of the instrument selectors 110A, 11B, 110C, 110D, 110E, 110F that corresponds to an instrument different than the one previously selected by the user at any time during the drawing process, the accompaniment music will remain the same but the selected instrument will become the active played instrument. Hence, the controller 30 recognizes when the user changes instruments while playing an accompaniment melody, and will select an audio content 74 that corresponds to the newly selected instrument and accompaniment style. Likewise, if the user selects a new accompaniment melody at any time during the drawing process, the active selected instrument type will remain the same, but the newly selected accompaniment melody will change as will the instrumental melody. Hence, the controller 30 recognizes when the user changes accompaniment melodies while playing an instrumental melody, and will select an audio content 74 that corresponds to the newly selected accompaniment melody, as well as an audio content 74 that corresponds to the previously selected instrument and the newly selected accompaniment style.

By selecting the replay selector 120, a user can listen to a song composed with the musical drawing assembly 40 at any time during the drawing process. Hence, the musical drawing assembly includes a playback feature. When the user of the musical drawing assembly selects the new song selector 206, a replay storage device 73 (see FIG. 4), such as a buffer, will be cleared. The controller 30 will then wait for a signal from the accompaniment selectors 100A–E or the instrumental selectors 110A–F. If there is no user input from the selectors 100A–E, 110A–F, the controller 30 will default to the last selected accompaniment and instrument. Hence, the controller will output the last selected accompaniment audio content 74, and will begin determining any type of drawing movement so as to select a corresponding instrument melody as described earlier.

The replay storage device 73 will store any accompaniment and instrumental played by the musical drawing assembly. Hence, if the controller 30 defaults to the last played accompaniment, the replay storage device 73 will begin storing the default accompaniment melody and any instrumental melody created by the user when the user creates drawing movement on the drawing pad 140. Likewise, if the user selects a new accompaniment melody and/or a new instrumental melody, the storage device will store the newly selected accompaniment melody and any created instrumental music. Instrumental melodies are played and stored in the replay storage device 73 in the same order they are created. For example, if a user creates a musical composition having a 10 seconds of classical accompaniment with a peaceful flute instrumental, and then 30 seconds of world accompaniment with a crazed xylophone instrumental, such compositions are stored in the replay storage device 73 in the order they are created. Any pauses between instrumental melody notes longer than a predetermined period of time, such as six seconds, will be stored as truncated silences of a predetermined time period, such as three seconds. The musical drawing assembly 40 will stop recording the created music when the storage device 73 is full. The storage device 73 can have the capacity to store a predetermined amount of composed musical, such as 2–30 minutes of composed music. A new song can be recorded by clearing the storage device by selecting the new song selector 206.

The storage device 73 can store a created composition as a digital audio file, such as a wave file. However, in the preferred embodiment, the replay storage device 73 stores a list of, ordered references, such as in file similar to a MIDI file, where each of the references in the list corresponds to one of the audio contents 74. Hence, when a user selects the replay selector 120, the controller 30 accesses the list of ordered references in the storage device 73 and plays back the composed musical composition by outputting, in order, the audio contents 74 that correspond to the stored list of references.

In the above-described manner, a user of the musical drawing assembly 40 can listen to a composed composition at any time by selecting the replay selector 120. The user can interrupt the playback of the composed composition by selecting the new song selector 206, the on/off selector 204, or the replay selector 120. If the storage device 73 is not full when the user selects the replay selector 120, the controller 30 will replay the stored composition and then revert back to a mode in which the user can add to the end of the recorded composition. This provides the user with the opportunity to finish an incomplete composition.

The musical drawing assembly 40 also has an automatic shut-off feature. After the user has turned on the musical drawing assembly 40 by selecting the on/off selector 204, if no input is received from the user after a predetermined period of time, such as 10 seconds, the controller will default to a predetermined accompaniment melody and instrumental melody, such as a techno accompaniment music style with a piano instrumental. If there is no further input after this default and after a further predetermined period of time, such as 30 seconds, the controller will stop playing the accompaniment melody and wait for an input from the user. If there is no further input after another predetermined period of time, such as 80 seconds, the controller 30 will automatically shut-off the musical drawing assembly 40.

The musical drawing assembly 40 also includes a handle 208 by which a user of the musical drawing assembly can grasp and carry the musical drawing assembly. Hence, the preferred embodiment of the musical drawing assembly is portable such that a user can easily carry the musical drawing assembly 40 with the assistance of the handle 208.

In an alternative embodiment, the musical drawing assembly 40 includes a demonstration function by which individuals can listen to prerecorded compositions. The demonstration function is initiated by pressing the replay selector 120, at which time the controller 30 will play the prerecorded compositions. The prerecorded compositions may be scrolled through by repeatedly selecting the replay selector 120. The demonstration function is available until a pull-tab or other device is removed from the musical drawing assembly, at which time the controller 30 reverts the replay selector to the functional operation describe above.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A musical drawing assembly comprising:

a drawing board on which a person can draw;

a sensor for sensing drawing movement on said drawing board;

a storage device storing musical melodies, said musical melodies each having a different succession of musical tones;

an output device; and a controller for determining a type of drawing movement on said drawing board based on an output from said senior, for selecting one of said musical melodies from said storage device based on said determined type of drawing movement, and for outputting said selected one of said musical melodies to said output device, said type of drawing movement being at least one of a speed of drawing movement and an acceleration of drawing movement.

2. The musical drawing assembly of claim 1, said output device including a speaker.

3. The musical drawing assembly of claim 1, said music melodies including music melodies of different musical instruments.

4. The musical drawing assembly of claim 1, said music melodies including a plurality of music melodies for a musical instrument.

5. The musical drawing assembly of claim 4, said plurality of musical melodies including a first melody and a second melody, said first melody having more notes per measure than said second melody.

6. The musical drawing assembly of claim 5, said type of drawing movement being said speed of drawing movement, said controller being configured to select said first melody when said speed of drawing movement is within a first range of drawing movement speed, said controller being configured to select said second melody when said speed of drawing movement is within a second range of drawing movement speed, said first range being drawing speeds that are higher than drawing speeds of said at second range.

7. The music drawing assembly of claim 1, said sensor including a plurality electrical contacts that close in response to drawing movement, said type of drawing movement being said speed of drawing movement, said speed of drawing movement being determined by one of counting a time between successive signals from said contacts and counting a number of signals from said contacts within a predetermined time.

8. The music drawing assembly of claim 1, said controller being a programmed microprocessor.

9. The music drawing assembly of claim 1, said musical melodies including a plurality of instrumental melodies for a plurality of different musical instruments.

10. The music drawing assembly of claim 1, said storage device storing accompaniment melodies, further comprising means for selecting one of said accompaniment melodies, each of said accompaniment melodies having a different succession of musical notes, said controller for outputting said selected one of said accompaniment melodies to said output device.

11. The music drawing assembly of claim 1, said musical melodies being musical melodies of a number of sets of musical melodies stored in said storage device, each of said sets of musical melodies corresponding to a different musical instrument, further comprising means for selecting one of said different musical instruments, said controller selecting said one musical melody from a particular set of said number of sets that corresponds to said selected musical instrument.

12. A musical drawing assembly comprising:

a drawing board on which a person can draw;

a storage device storing at least a first musical melody and a second musical melody, said first musical melody having a different succession of musical tones than said second musical melody; and means for detecting a type of drawing movement on said drawing board and for generating music in response to said detected type of drawing movement, said type of drawing movement being at least one of a speed of drawing movement and an acceleration of drawing movement, said music including one of said first musical melody and said second musical melody dependent upon said detected type of drawing movement.

13. The musical drawing assembly of claim 12, said type of drawing movement being said speed of drawing movement.

14. The musical drawing assembly of claim 12, said first musical melody having more notes per measure than said second musical melody.

15. The musical drawing assembly of claim 14, said first musical melody and said second musical melody having a same tempo.

16. The musical drawing assembly of claim 12, said first musical melody and said second musical melody being musical melodies of one musical instrument.

17. The musical drawing assembly of claim 12, said storage device storing at least a third musical melody and a fourth musical melody, said third musical melody having a different succession of musical tones than said fourth musical melody, said third musical melody and said fourth musical melody being musical melodies of another musical instrument that is different than said one musical instrument.

18. The musical drawing assembly of claim 17, further comprising means for selecting an instrument corresponding to one of said one musical instrument and said another musical instrument.

19. The musical drawing assembly of claim 12, said storage device storing a plurality of different accompaniment melodies each having a different succession of musical tones, said succession of musical tones of each of said accompaniment melodies being different than said succession of musical tones of said first musical melody and said succession of musical tones of said second musical melody.

20. The musical drawing assembly of claim 19, further comprising means for selecting one of said accompaniment melodies, said music including said selected one of said accompaniment melodies.

21. The musical drawing assembly of claim 19, said storage device storing at least a first set of musical melodies corresponding to a first musical instrument and a second set of musical melodies corresponding to a second musical instrument, said first musical melody and said second musical melody being melodies in said first set of musical melodies.

22. A musical drawing assembly comprising:

a drawing board on which a person can draw;

a sensor adapted to sense drawing movement on said drawing board;

a storage device storing a plurality of accompaniment melodies each having a different succession of musical tones, said storage device storing a plurality of instrumental melodies corresponding to different musical instruments and each having a different succession of musical tones;

means for selecting one of said accompaniment melodies;

means for selecting a musical instrument that corresponds to one of said different musical instruments;

an output device for outputting music; and a controller configured to output said selected one of said accompaniment melodies to said output device during said drawing movement and to output one of said instrumental melodies that corresponds to said selected instrument to said output device in response to said drawing movement.

23. The musical drawing assembly of claim 22, said plurality of instrumental melodies including a set of melodies of said selected musical instrument, said controller being further configured to detect a type of drawing movement on said drawing board, and to select one of said instrumental melodies from said set of melodies of said selected musical instrument based on said determined type of drawing movement.

24. The musical drawing assembly of claim 23, each of said instrumental melodies of said set having a different number of notes per measure.

25. The musical drawing assembly of claim 22, said controller being further configured to detect at least one of a speed of drawing movement and an acceleration of drawing movement.

26. A method of generating music comprising:

sensing drawing movement on a drawing board;

determining a type of drawing movement on the drawing board based on the sensed drawing movement, the type of drawing movement being at least one of a speed of drawing movement and an acceleration of drawing movement;

selecting a musical melody from a plurality of stored musical melodies based on the determined type of drawing movement, said musical melodies each having a different succession of musical tones; and outputting said selected one of said musical melodies to an output device.

27. The method of claim 26, said determining the type of drawing movement including one of counting a time between successive signals from a sensor and counting a number of signals from the sensor within a predetermined time.

28. The method of claim 26, further comprising:

receiving a selection of a musical instrument; and determining which of the plurality of stored melodies corresponds to the selected musical instrument, said selecting of the musical melody being only from melodies determined to correspond to the selected musical instrument.

29. The method of claim 26, further comprising:

receiving a selection of an accompaniment melody; and outputting the selected accompaniment melody to the output device.

30. A method of generating music comprising:

receiving a selection of an accompaniment melody;

receiving a selection of a musical instrument;

sensing drawing movement on a drawing board;

determining a type of drawing movement on the drawing board, the type of drawing movement being at least one of a speed of drawing movement and an acceleration of drawing movement;

determining which of a plurality of stored instrument melodies corresponds to the selected musical instrument;

outputting to an output device in response to the sensed drawing movement at least one of the instrument melodies determined to correspond to the selected musical instrument; and outputting the selected accompaniment melody to the output device.

31. The method of claim 30, further comprising:

selecting one of the musical melodies determined to correspond to the selected musical instrument based on the determined type of drawing movement, said outputting including outputting the selected one of the musical melodies determined to correspond to the selected musical instrument based on the determined type of drawing movement.

* * * * *